US011161016B2

(12) United States Patent
Yamamoto et al.

(10) Patent No.: US 11,161,016 B2
(45) Date of Patent: Nov. 2, 2021

(54) RACKET

(71) Applicant: SUMITOMO RUBBER INDUSTRIES, LTD., Hyogo (JP)

(72) Inventors: Yosuke Yamamoto, Hyogo (JP); Kohei Mimura, Hyogo (JP)

(73) Assignee: SUMITOMO RUBBER INDUSTRIES, LTD., Hyogo (JP)

( * ) Notice: Subject to any disclaimer, the term of this patent is extended or adjusted under 35 U.S.C. 154(b) by 87 days.

(21) Appl. No.: 16/808,627

(22) Filed: Mar. 4, 2020

(65) Prior Publication Data

US 2020/0298069 A1 Sep. 24, 2020

(30) Foreign Application Priority Data

Mar. 19, 2019 (JP) ..... JP2019-050966
Mar. 19, 2019 (JP) ..... JP2019-050967

(51) Int. Cl.

| | |
|---|---|
| ***A63B 49/02*** | (2015.01) |
| ***A63B 51/02*** | (2015.01) |
| ***A63B 49/022*** | (2015.01) |
| *A63B 102/02* | (2015.01) |
| *A63B 60/14* | (2015.01) |

(52) U.S. Cl.

CPC ..... *A63B 49/022* (2015.10); *A63B 51/02* (2013.01); *A63B 60/14* (2015.10); *A63B 2102/02* (2015.10); *A63B 2209/023* (2013.01)

(58) Field of Classification Search

CPC ..... A63B 49/022; A63B 51/02
See application file for complete search history.

(56) References Cited

U.S. PATENT DOCUMENTS

| | | | | |
|---|---|---|---|---|
| 5,332,213 | A | 7/1994 | Klose | |
| 6,071,203 | A * | 6/2000 | Janes | A63B 49/022 473/535 |
| 7,887,444 | B1 * | 2/2011 | Severa | A63B 49/022 473/539 |
| 2006/0172828 | A1 * | 8/2006 | Pezzato | A63B 49/11 473/527 |
| 2015/0018137 | A1 * | 1/2015 | Schwenger | A63B 49/022 473/540 |
| 2017/0173407 | A1 | 6/2017 | Ogawa et al. | |

FOREIGN PATENT DOCUMENTS

| | | | | |
|---|---|---|---|---|
| EP | 0884074 | A2 * | 12/1998 | A63B 49/022 |
| EP | 3711824 | A1 * | 9/2020 | A63B 49/022 |
| JP | 5-345052 | | 12/1993 | |
| JP | 2015-217192 | | 12/2015 | |
| JP | 2017-113124 | A * | 6/2017 | A63B 49/022 |
| JP | 2020-141993 | A * | 9/2020 | A63B 49/022 |
| JP | 2020-141994 | A * | 9/2020 | A63B 49/022 |
| WO | WO-98/28049 | A1 * | 7/1998 | A63B 49/022 |
| WO | WO-2015/177937 | A1 * | 11/2015 | A63B 51/10 |

* cited by examiner

*Primary Examiner* — Raleigh W Chiu
(74) *Attorney, Agent, or Firm* — Greenblum & Bernstein, P.L.C.

(57) ABSTRACT

A grommet of a racket includes a tubular portion. The tubular portion has a through hole through which a string is passed. The through hole has a base-side opening, a side wall, and a tip-side opening. In the tip-side opening, an inner dimension in a direction parallel to a face is larger than an inner dimension in a direction perpendicular to the face. In the tubular portion, the string is in contact with the side wall from the base-side opening to the tip-side opening.

20 Claims, 33 Drawing Sheets

RACKET

CROSS-REFERENCE TO RELATED APPLICATION

This application claims priority on and the benefit of Patent Application No. 2019-050966 filed in JAPAN on Mar. 19, 2019 and Patent Application No. 2019-050967 filed in JAPAN on Mar. 19, 2019. The entire disclosures of these Japanese Patent Applications are hereby incorporated by reference.

BACKGROUND OF THE INVENTION

Field of the Invention

The present invention relates to rackets for use in tennis, etc.

Description of the Related Art

A tennis racket includes a frame and a string. In the old days, a string is directly inserted through holes formed in a frame. In a recent tennis racket, a string is inserted through holes with grommets therebetween. JPH5-345052 and JP2015-217192 disclose proposals regarding the shapes of grommets.

A tennis player tries to hit a ball at the center of the face of a racket. However, in tennis play, hitting at a position shifted from the center frequently occurs. When a ball is hit at the lower side (ground side) with respect to the center, the ball flies at a small launch angle due to a change in the angle of the face. This launch angle causes a low trajectory. A ball with a low trajectory is less likely to pass over the net.

With enhancement of the performance of tennis rackets, drive shots are frequently used in recent tennis. Upon a drive shot, overspin is imparted to a tennis ball. Players desire tennis rackets with which spin is easily imparted.

An object of the present invention is to provide a racket with which a stable trajectory can be obtained even when a ball is hit at a position shifted from the center of a face.

Another object of the present invention is to provide a racket having excellent spin performance.

SUMMARY OF THE INVENTION

A racket according to an aspect of the present invention includes (1) a frame, (2) a grommet mounted on the frame and having a plurality of tubular portions, and (3) a string forming a face.

Each of the tubular portions has a through hole through which the string is passed. The through hole has a base-side opening, a side wall, and a tip-side opening. At least one of the tubular portions has a non-circular tip-side opening in which an inner dimension in a direction parallel to the face is larger than an inner dimension in a direction perpendicular to the face. In the tubular portion having the non-circular tip-side opening, the string is in contact with the side wall from the base-side opening to the tip-side opening.

With the racket according to the present invention, the string easily becomes deformed, and thus a contact time between the string and a ball upon a stroke is long. The racket can contribute to a large launch angle.

Preferably, a longitudinal string is passed through the tubular portion having the non-circular tip-side opening.

Preferably, the tubular portion having the non-circular tip-side opening is disposed near a top of the frame. Preferably, in the tubular portion having the non-circular tip-side opening, the string is in contact with a wall surface, at an inner side in a width direction, of the side wall.

Preferably, the tubular portion having the non-circular tip-side opening has a through hole having a uniform cross-sectional shape from the base-side opening to the tip-side opening.

Preferably, a contour of the non-circular tip-side opening is an ellipse or an elongated circle.

Preferably, a ratio (L1/L2) of an inner dimension L1, in the direction parallel to the face, of the non-circular tip-side opening to an inner dimension L2, in the direction perpendicular to the face, of the non-circular tip-side opening is not less than 1.3.

Preferably, a ratio (L1/D) of an inner dimension L1, in the direction parallel to the face, of the non-circular tip-side opening to a diameter D of the string is not less than 1.5.

A racket according to another aspect of the present invention includes (1) a frame, (2) a grommet mounted on the frame and having a plurality of tubular portions, and (3) a string forming a face.

Each of the tubular portions has a through hole through which the string is passed. The tubular portions include parallel movement tubular portions that mainly permit movement of the string in a direction parallel to the face, and vertical movement tubular portions that mainly permit movement of the string in a direction perpendicular to the face.

With the racket according to the present invention, upon impact with a ball, the string passed through each of the parallel movement tubular portions becomes greatly deformed in the direction parallel to the face. Thereafter, the string returns to the original shape. By the deformation and the return, high-rate spin is imparted to the ball.

With the racket according to the present invention, upon impact with a ball, the string passed through each of the vertical movement tubular portions becomes greatly deformed in the direction perpendicular to the face. Meanwhile, deformation, in the direction perpendicular to the face, of the string passed through each of the parallel movement tubular portions is small. Therefore, great pressure is applied to the ball from the string passed through each of the parallel movement tubular portions. By this pressure, high-rate spin is imparted to the ball.

Preferably, each of the parallel movement tubular portions is adjacent to at least one vertical movement tubular portion. Preferably, each of the vertical movement tubular portions is adjacent to at least one parallel movement tubular portion.

Preferably, each of the parallel movement tubular portions has a through hole in which an inner dimension in the direction parallel to the face is larger than an inner dimension in the direction perpendicular to the face. Preferably, a cross-sectional shape of the through hole of each of the parallel movement tubular portions is an ellipse or an elongated circle. Preferably, a ratio (L1/L2) of an inner dimension L1, in the direction parallel to the face, of the through hole of each of the parallel movement tubular portions to an inner dimension L2, in the direction perpendicular to the face, of the through hole of each of the parallel movement tubular portions is not less than 1.3. Preferably, a ratio (L1/D) of an inner dimension L1, in the direction parallel to the face, of the through hole of each of the parallel movement tubular portions to a diameter D of the string is not less than 1.5.

The through hole of each of the parallel movement tubular portions can have a base-side opening, a side wall, and a tip-side opening. Preferably, in each of the parallel movement tubular portions, the string is in contact with the side wall from the base-side opening to the tip-side opening. Preferably, in each of the parallel movement tubular portions, the string is in contact with a wall surface, at an inner side in a width direction, of the side wall.

Preferably, each of the parallel movement tubular portions has a through hole having a uniform cross-sectional shape from the base-side opening to the tip-side opening.

Preferably, a longitudinal string is passed through each of the parallel movement tubular portions, and another longitudinal string is passed through each of the vertical movement tubular portions.

Preferably, the parallel movement tubular portions and the vertical movement tubular portions are disposed near a top of the frame.

BRIEF DESCRIPTION OF THE DRAWINGS

FIG. 5(*b*) is a cross-sectional view taken along a line B-B in FIG. 5(*a*);

FIG. 6(*b*) is a cross-sectional view taken along a line B-B in FIG. 6(*a*);

FIG. 7(*b*) is a cross-sectional view taken along a line B-B in FIG. 7(*a*);

FIG. 12(*b*) is a cross-sectional view taken along a line B-B in FIG. 12(*a*);

FIG. 14(*b*) is a cross-sectional view taken along a line B-B in FIG. 14(*a*);

FIG. 21(*b*) is a cross-sectional view taken along a line B-B in FIG. 21(*a*);

FIG. 21(*c*) is a cross-sectional view taken along a line C-C in FIG. 21(*a*);

FIG. 22(*b*) is a cross-sectional view taken along a line B-B in FIG. 22(*a*);

FIG. 22(*c*) is a cross-sectional view taken along a line C-C in FIG. 22(*a*);

FIG. 23(*b*) is a cross-sectional view taken along a line B-B in FIG. 23(*a*);

FIG. 24(*b*) is a cross-sectional view taken along a line B-B in FIG. 24(*a*);

FIG. 33(*b*) is a cross-sectional view taken along a line B-B in FIG. 33(*a*); and FIG. 33(*c*) is a cross-sectional view taken along a line C-C in FIG. 33(*a*).

DESCRIPTION OF THE PREFERRED EMBODIMENTS

The following will describe in detail the present invention based on preferred embodiments with appropriate reference to the drawings.

First Invention

First Embodiment

Figure 1:
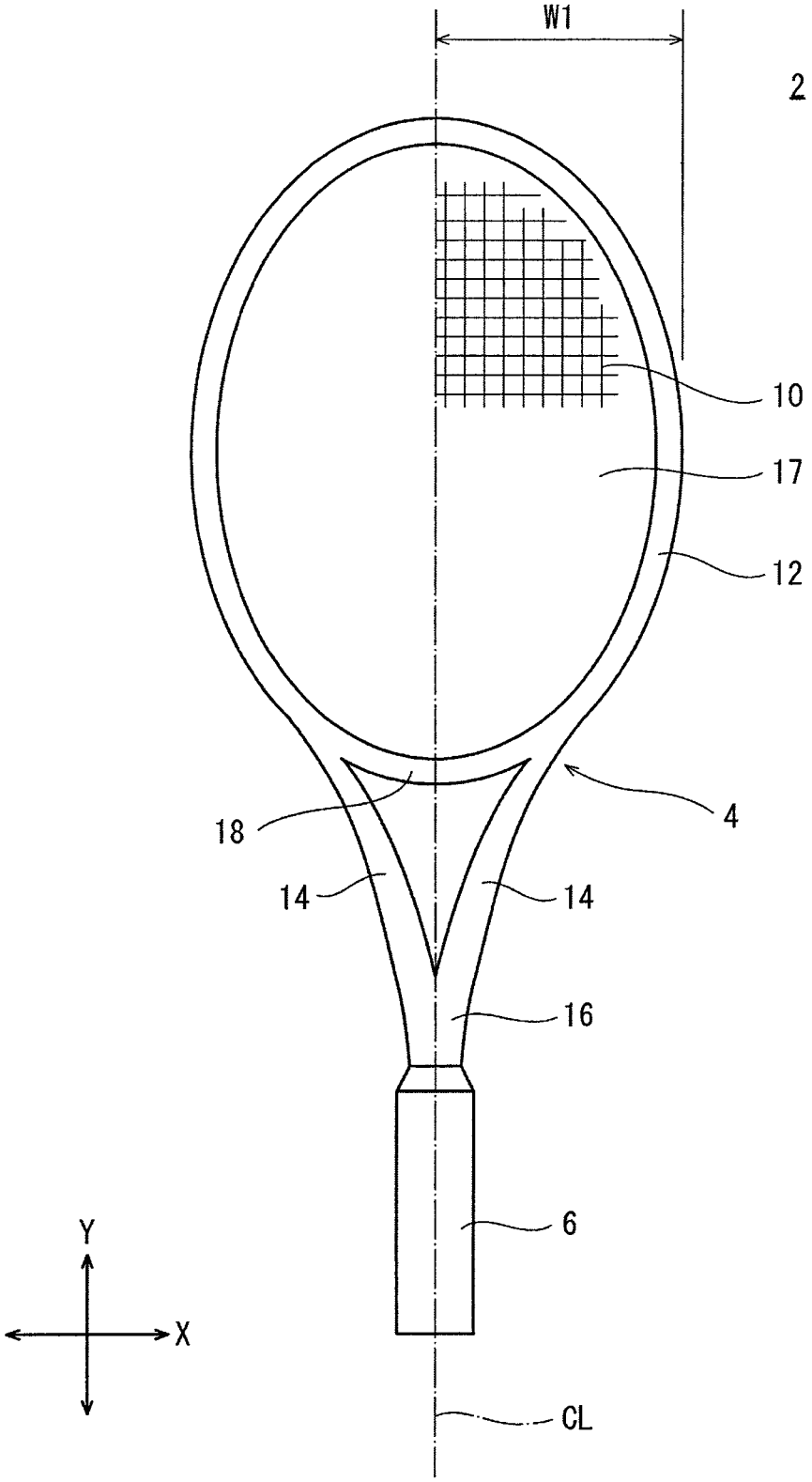
FIG. 1 is a front view of a racket according to an embodiment of the present invention.
Figure 2:
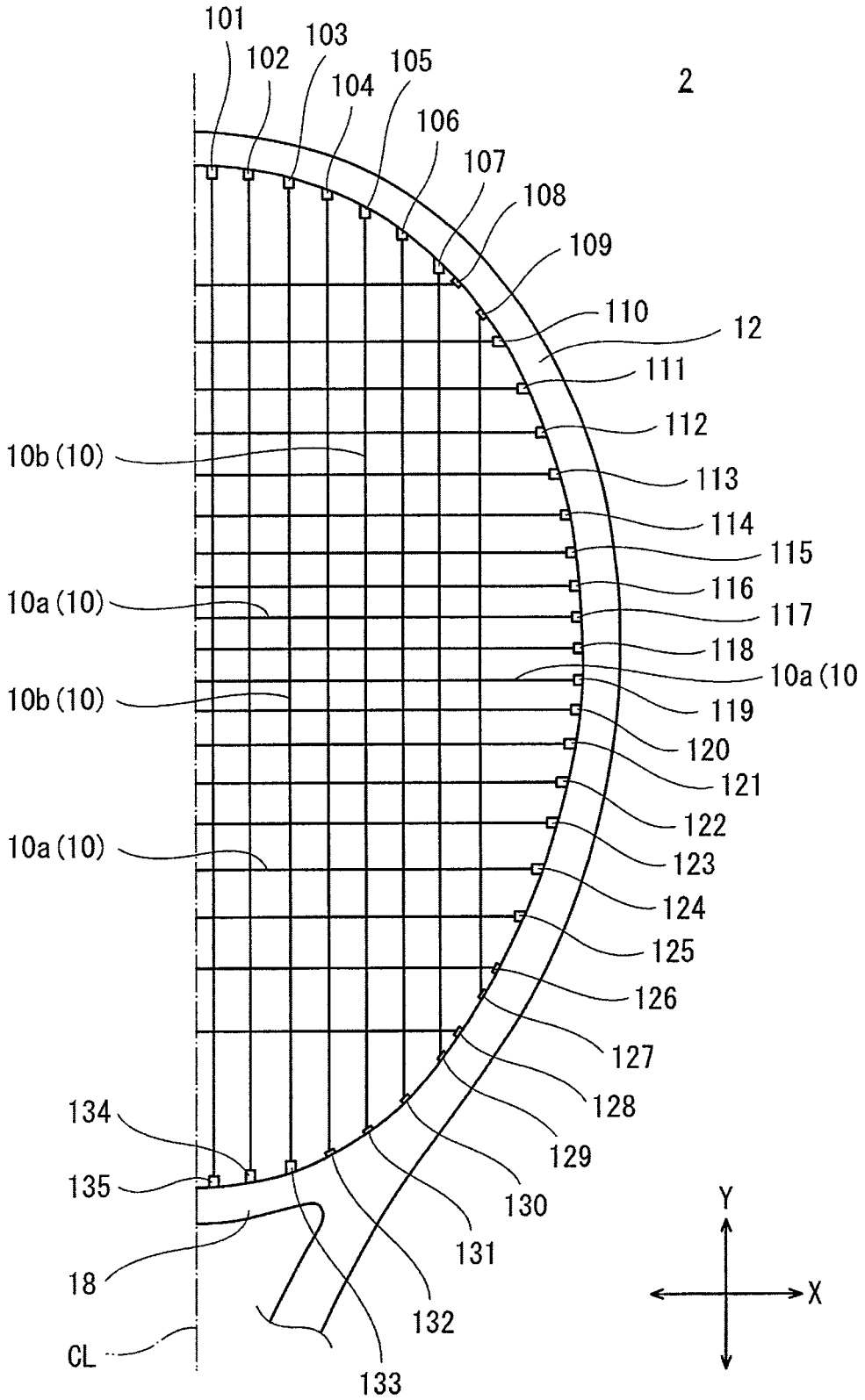
FIG. 2 is an enlarged view of a part of the racket in FIG. 1.
Figure 3:
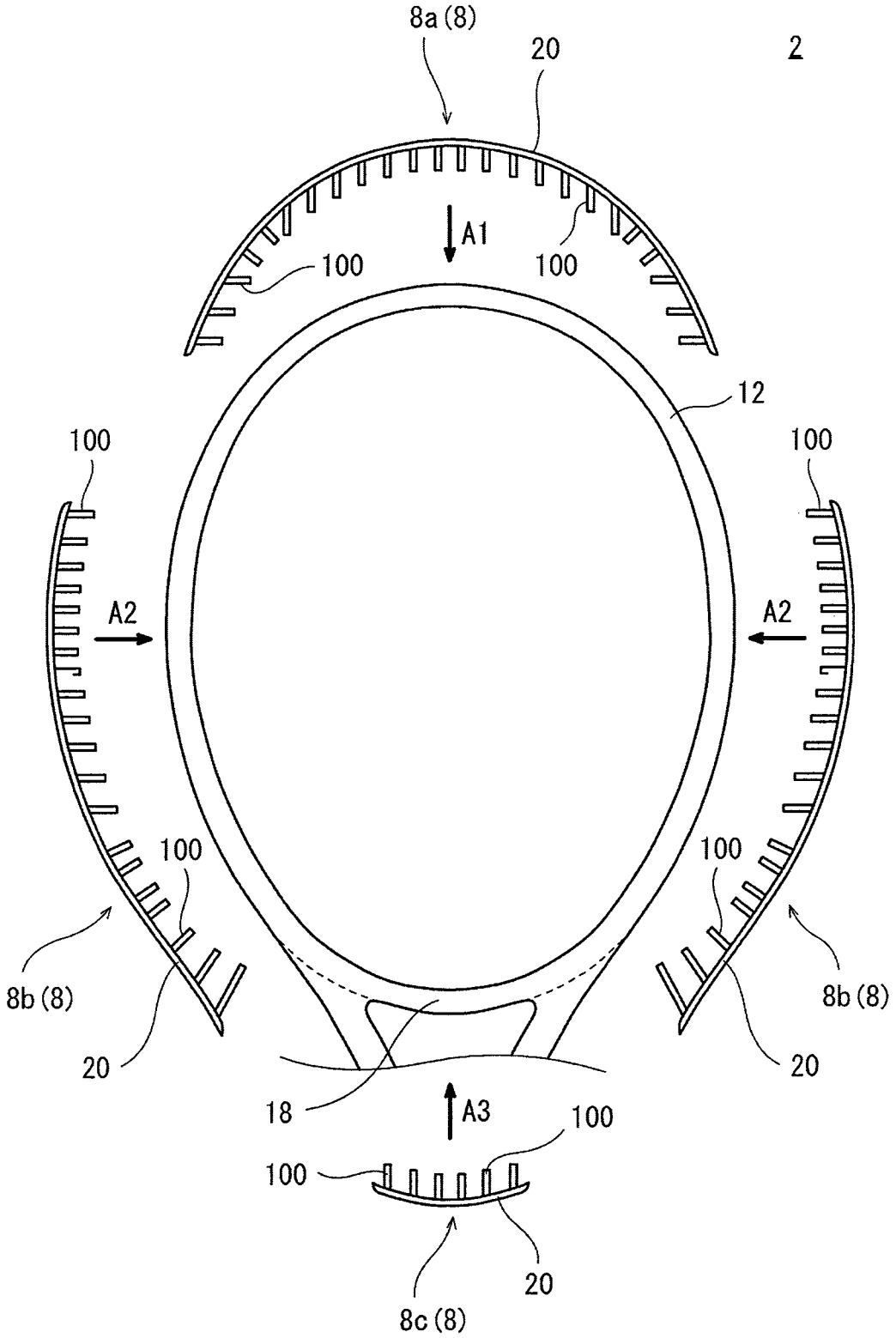
FIG. 3 is an exploded view of a part of the racket in FIG. 1.

FIGS. 1 to 3 show a tennis racket 2. The tennis racket 2 includes a frame 4, a grip 6, grommets 8, and a string 10. The tennis racket 2 can be used in regulation-ball tennis. In FIGS. 1 and 2, an arrow X represents the width direction of the tennis racket 2, and an arrow Y represents the axial direction of the tennis racket 2.

The frame 4 includes a head 12, two throats 14, and a shaft 16. The head 12 forms the contour of a face 17 (described in detail later). The front shape of the head 12 is substantially an ellipse. The major axis direction of the ellipse coincides with the axial direction Y of the tennis racket 2. The minor axis direction of the ellipse coincides with the width direction X of the tennis racket 2. One end of each throat 14 is connected to the head 12. The throat 14 is connected at the vicinity of the other end thereof to the other throat 14. The throats 14 extend from the head 12 to the shaft 16. The shaft 16 extends from the location where the two throats 14 are connected to each other. The shaft 16 is formed so as to be integrally connected to the throats 14. A portion, of the head 12, located between the two throats 14 is a yoke 18. The head 12 may have a shape other than an ellipse.

The frame 4 is composed of a pipe. In other words, the frame 4 is hollow. The material of the pipe is a fiber-reinforced resin. The matrix resin of the fiber-reinforced resin is a thermosetting resin. A typical thermosetting resin is an epoxy resin. Typical fibers of the fiber-reinforced resin are carbon fibers. The fibers are long fibers.

The grip 6 is formed by a tape wound on the shaft 16. The grip 6 suppresses slip between a hand of a player and the tennis racket 2 when the tennis racket 2 is swung.

As shown in FIG. 3, the tennis racket 2 includes a first grommet 8*a*, two second grommets 8*b*, and a third grommet 8*c*. Each grommet 8 includes a base 20 and a plurality of tubular portions 100. Each tubular portion 100 is formed so as to be integrated with the base 20. A typical material of the grommet 8 is a synthetic resin that is more flexible than the frame 4.

The first grommet 8*a* is mounted onto a portion at and near the top of the head 12 as shown by an arrow A1 in FIG. 3. As a result of the mounting, each tubular portion 100 of the first grommet 8*a* penetrates a hole (not shown) provided in the head 12. Each second grommet 8*b* is mounted onto a side of the head 12 as shown by an arrow A2 in FIG. 3. As a result of the mounting, each tubular portion 100 of the second grommet 8*b* penetrates a hole (not shown) provided in the head 12. The third grommet 8*c* is mounted onto the yoke 18 as shown by an arrow A3 in FIG. 3. As a result of the mounting, each tubular portion 100 of the third grommet 8*c* penetrates a hole (not shown) provided in the head 12.

The string 10 is stretched on the head 12. The string 10 is stretched along the width direction X and the axial direction Y. Of the string 10, portions extending along the width direction X are referred to as transverse strings 10*a*. Of the string 10, portions extending along the axial direction Y are referred to as longitudinal strings 10*b*. The face 17 (see FIG. 1) is formed by a plurality of transverse strings 10*a* and a plurality of longitudinal strings 10*b*. The face 17 generally extends along an X-Y plane.

Figure 4:
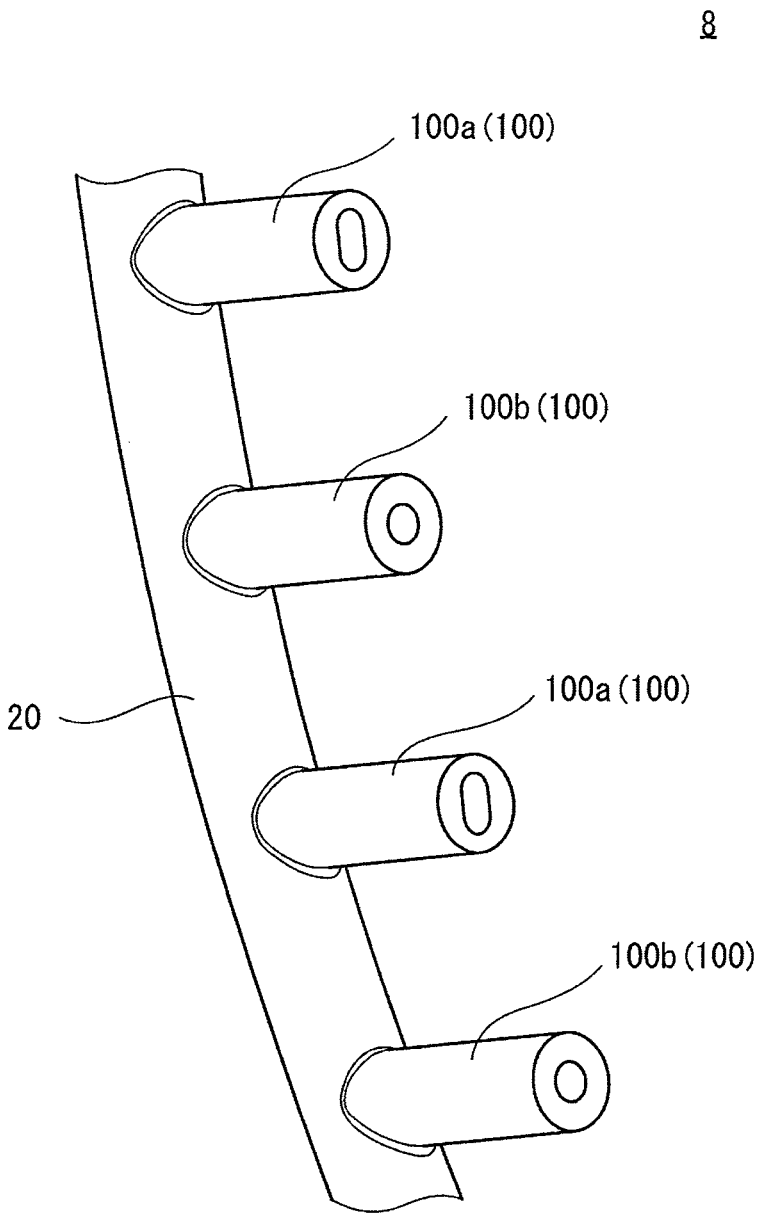
FIG. 4 is an enlarged view of a part of a grommet of the tennis racket in FIG. 3.

FIG. 4 is an enlarged view of a part of the grommet 8 of the tennis racket 2 in FIG. 3. As described above, the grommet 8 includes the base 20 and the plurality of tubular portions 100.

Figure 5:
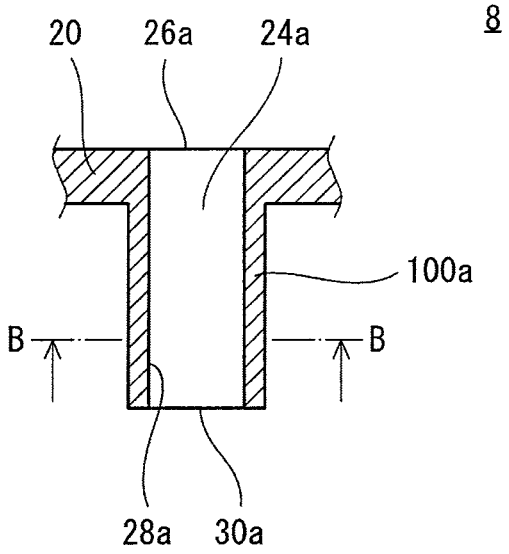
FIG. 5(*a*) is an enlarged cross-sectional view of a part of the grommet in FIG. 4.
Figure 5:
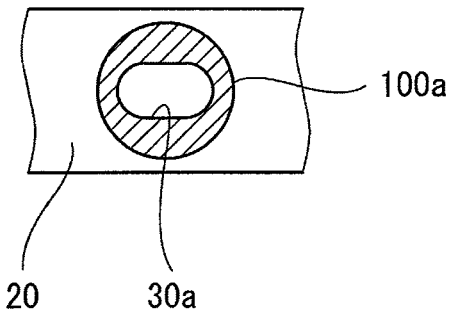

FIGS. 5(*a*) and 5(*b*) show a part of the grommet 8. FIG. 5(*a*) is a cross-sectional view taken along a plane including the axis of a tubular portion 100*a*. FIG. 5(*b*) is a cross-sectional view taken along a plane perpendicular to the axis of the tubular portion 100*a*. As shown in these drawings, the tubular portion 100*a* has a through hole 24*a*. The through hole 24*a* has a base-side opening 26*a*, a side wall 28*a*, and a tip-side opening 30*a*. As shown in FIG. 5(*b*), the cross-sectional shape of the through hole 24*a* is an elongated circle. The through hole 24*a* has a uniform cross-sectional shape from the base-side opening 26*a* to the tip-side opening 30*a*. Therefore, the shape of the tip-side opening 30*a* is an elongated circle (that is, non-circular). In the tip-side opening 30*a*, the inner dimension in a direction parallel to the face 17 (the right-left direction in FIG. 5(*b*)) is larger than the inner dimension in a direction perpendicular to the face 17 (the up-down direction in FIG. 5(*b*)).

Figure 6A:
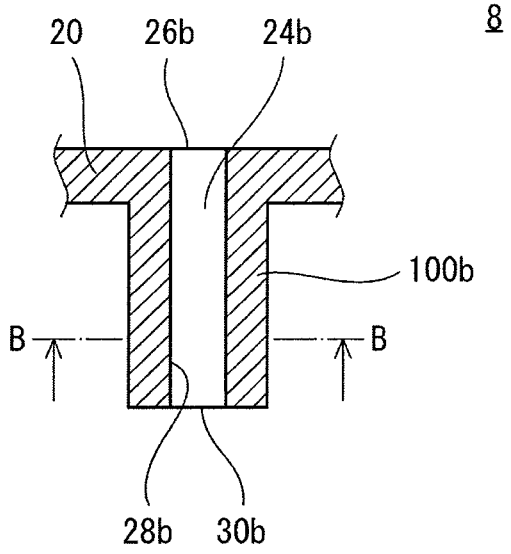
FIG. 6(*a*) is an enlarged cross-sectional view of a part of the grommet in FIG. 4.
Figure 6B:
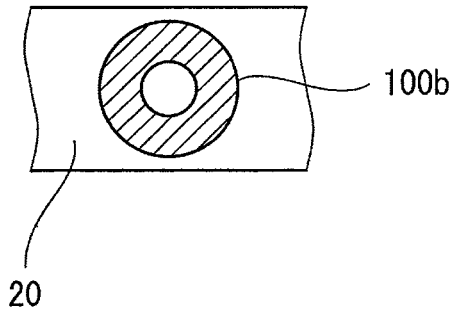

FIGS. 6(*a*) and 6(*b*) show another part of the grommet 8. FIG. 6(*a*) is a cross-sectional view taken along a plane including the axis of a tubular portion 100*b*. FIG. 6(*b*) is a cross-sectional view taken along a plane perpendicular to the axis of the tubular portion 100*b*. As shown in these drawings, the tubular portion 100*b* has a through hole 24*b*. The through hole 24*b* has a base-side opening 26*b*, a side wall 28*b*, and a tip-side opening 30*b*. As shown in FIG. 6(*b*), the cross-sectional shape of the through hole 24*b* is a circle. The through hole 24*b* has a uniform cross-sectional shape from the base-side opening 26*b* to the tip-side opening 30*b*. Therefore, the shape of the tip-side opening 30*b* is a circle. In the tip-side opening 30*b*, the inner dimension in the direction parallel to the face 17 (the right-left direction in FIG. 6(*b*)) is equal to the inner dimension in the direction perpendicular to the face 17 (the up-down direction in FIG. 6(*b*)).

Figure 7A:
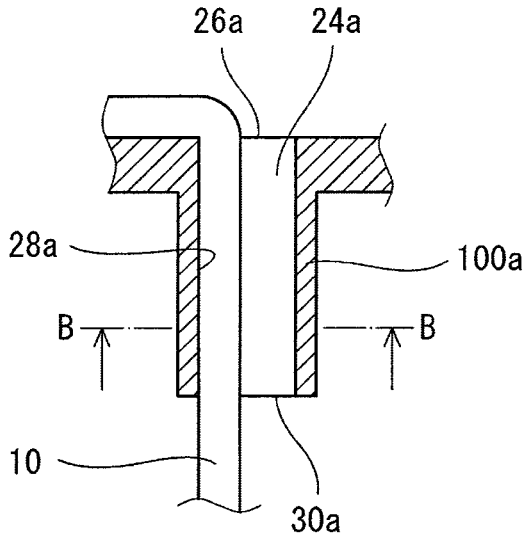
FIG. 7(*a*) is a cross-sectional view of the grommet in FIGS. 5(*a*) and 5(*b*) with a string.
Figure 7B:
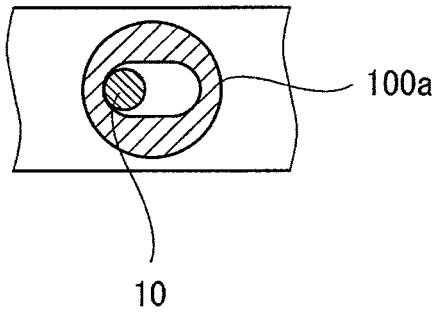

FIGS. 7(*a*) and 7(*b*) show the tubular portion 100*a* in FIGS. 5(*a*) and 5(*b*). FIGS. 7(*a*) and 7(*b*) also show the string 10. The string 10 is passed through the through hole 24*a*. The string 10 is in contact with the side wall 28*a* from the base-side opening 26*a* to the tip-side opening 30*a*. The string 10 is in contact with a left side wall surface of the side wall 28*a*. Since the inner dimension in the right-left direction of the base-side opening 26*a* is equal to the inner dimension in the right-left direction of the tip-side opening 30*a*, the string 10 can be in contact with the side wall 28*a* from the base-side opening 26*a* to the tip-side opening 30*a*. The inner dimension in the right-left direction of the base-side opening 26*a* may be larger than the inner dimension in the right-left direction of the tip-side opening 30*a*. As is obvious from FIGS. 7(*a*) and 7(*b*), the inner dimension in the right-left direction of the through hole 24*a* is sufficiently larger than the diameter of the string 10. Therefore, the string 10 can move rightward in the tubular portion 100*a*. The tubular portion 100*a* mainly permits movement of the string 10 in the right-left direction (the direction parallel to the face 17).

In FIG. 2, reference character CL indicates a center line. The tennis racket 2 has a symmetrical shape with respect to the center line CL. As shown in FIG. 2, the tennis racket 2 includes a first tubular portion 101, a second tubular portion 102, a third tubular portion 103, a fourth tubular portion 104, a fifth tubular portion 105, a sixth tubular portion 106, a seventh tubular portion 107, an eighth tubular portion 108, a ninth tubular portion 109, a tenth tubular portion 110, an eleventh tubular portion 111, a twelfth tubular portion 112, a thirteenth tubular portion 113, a fourteenth tubular portion 114, a fifteenth tubular portion 115, a sixteenth tubular portion 116, a seventeenth tubular portion 117, an eighteenth tubular portion 118, a nineteenth tubular portion 119, a twentieth tubular portion 120, a twenty-first tubular portion 121, a twenty-second tubular portion 122, a twenty-third tubular portion 123, a twenty-fourth tubular portion 124, a twenty-fifth tubular portion 125, a twenty-sixth tubular portion 126, a twenty-seventh tubular portion 127, a twenty-eighth tubular portion 128, a twenty-ninth tubular portion 129, a thirtieth tubular portion 130, a thirty-first tubular portion 131, a thirty-second tubular portion 132, a thirty-third tubular portion 133, a thirty-fourth tubular portion 134, and a thirty-fifth tubular portion 135. FIG. 2 shows 35 tubular portions 100. Since the tennis racket 2 has a symmetrical shape with respect to the center line CL as described above, the number of tubular portions 100 in the tennis racket 2 is 70.

As shown in FIG. 2, the longitudinal strings 10*b* are passed through the first tubular portion 101, the second tubular portion 102, the third tubular portion 103, the fourth tubular portion 104, the fifth tubular portion 105, the sixth tubular portion 106, the seventh tubular portion 107, the ninth tubular portion 109, the twenty-seventh tubular portion 127, the twenty-ninth tubular portion 129, the thirtieth tubular portion 130, the thirty-first tubular portion 131, the thirty-second tubular portion 132, the thirty-third tubular portion 133, the thirty-fourth tubular portion 134, and the thirty-fifth tubular portion 135. The transverse strings 10*a* are passed through the eighth tubular portion 108, the tenth tubular portion 110, the eleventh tubular portion 111, the twelfth tubular portion 112, the thirteenth tubular portion 113, the fourteenth tubular portion 114, the fifteenth tubular portion 115, the sixteenth tubular portion 116, the seventeenth tubular portion 117, the eighteenth tubular portion 118, the nineteenth tubular portion 119, the twentieth tubular portion 120, the twenty-first tubular portion 121, the twenty-second tubular portion 122, the twenty-third tubular portion 123, the twenty-fourth tubular portion 124, the twenty-fifth tubular portion 125, the twenty-sixth tubular portion 126, and the twenty-eighth tubular portion 128.

In the present embodiment, the second tubular portion 102 and the fourth tubular portion 104 each have a through hole 24*a* (see FIGS. 5(*a*) and 5(*b*)) with a cross-sectional shape that is an elongated circle. The other tubular portions 100 each have a through hole 24*b* (see FIGS. 6(*a*) and 6(*b*)) with a cross-sectional shape that is a circle. The tubular portions 100 other than the second tubular portion 102 and the fourth tubular portion 104 may each have a through hole 24*a* with a cross-sectional shape that is an elongated circle. For example, the sixth tubular portion 106 may have a through hole 24*a* with a cross-sectional shape that is an elongated circle.

Figure 8:
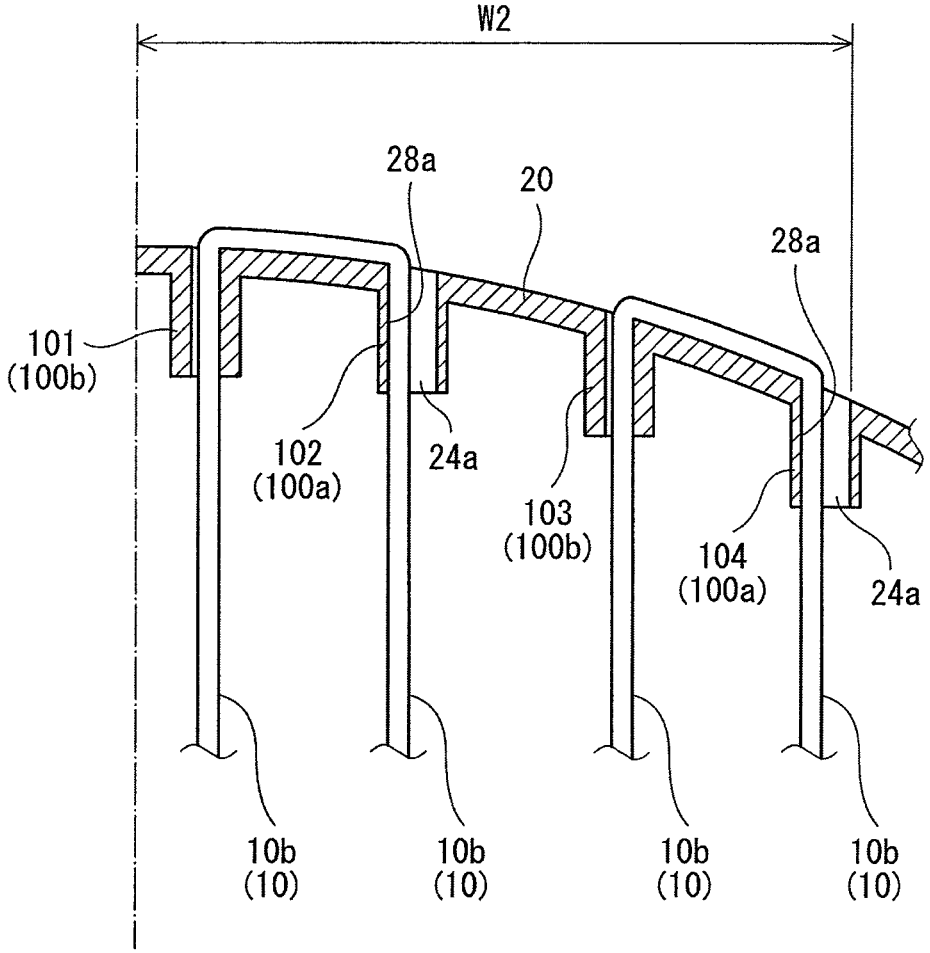
FIG. 8 is an enlarged view of an area near the top of the racket in FIG. 1.

FIG. 8 is an enlarged view of an area near the top of the tennis racket 2 in FIG. 1. In FIG. 8, the frame 4 and the transverse strings 10*a* are not shown. FIG. 8 shows the base 20, the first tubular portion 101, the second tubular portion 102, the third tubular portion 103, and the fourth tubular portion 104. The first tubular portion 101 has a through hole 24*b* (see FIGS. 6(*a*) and 6(*b*)) with a cross-sectional shape that is a circle. The second tubular portion 102 has a through hole 24*a* with a cross-sectional shape that is an elongated circle. The third tubular portion 103 has a through hole 24*b* with a cross-sectional shape that is a circle. The fourth tubular portion 104 has a through hole 24*a* with a cross-sectional shape that is an elongated circle. In the second tubular portion 102, the string 10 is in contact with the wall surface, at the left side (the inner side in the width direction), of the side wall 28*a* of the through hole 24*a*. In the fourth tubular portion 104, the string 10 is in contact with the wall surface, at the left side (the inner side in the width direction), of the side wall 28*a* of the through hole 24*a*.

Figure 9:
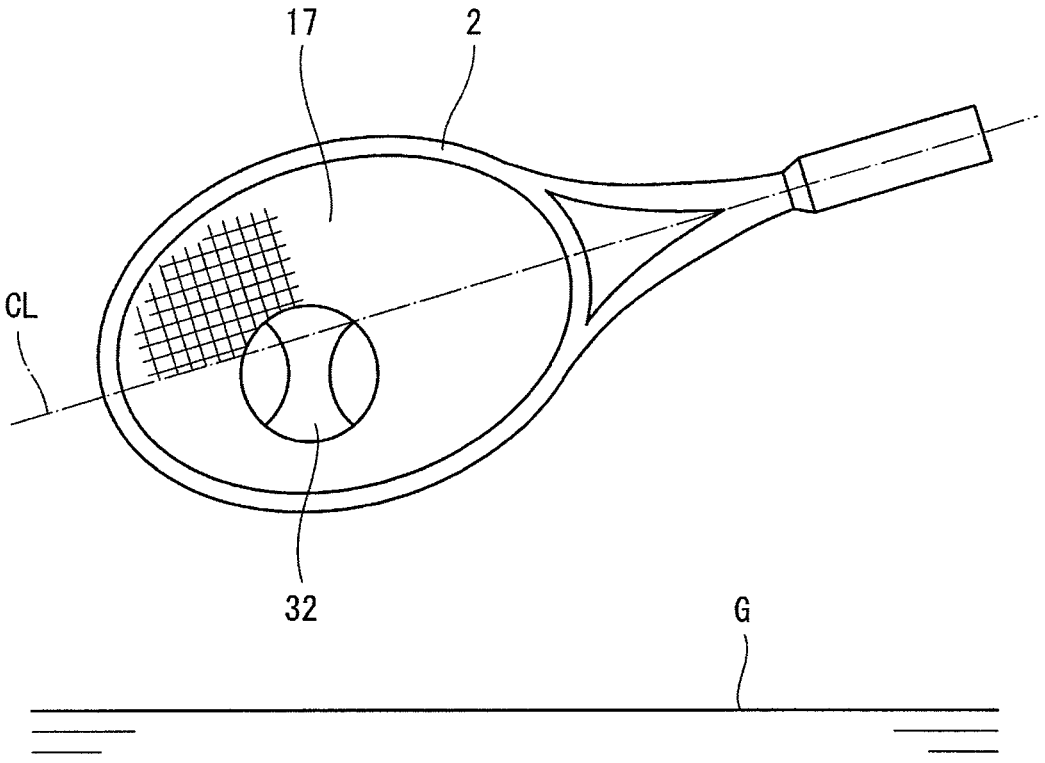
FIG. 9 is a front view of the racket in FIG. 1 with a tennis ball.

FIG. 9 shows a tennis ball 32 together with the tennis racket 2. FIG. 9 shows the moment of impact between the tennis racket 2 and the tennis ball 32. In FIG. 9, the tennis ball 32 collides against the face 17 at the lower side (the ground G side) with respect to the center line CL. In this state, the player swings the tennis racket 2 forward and then upward.

Figure 10:
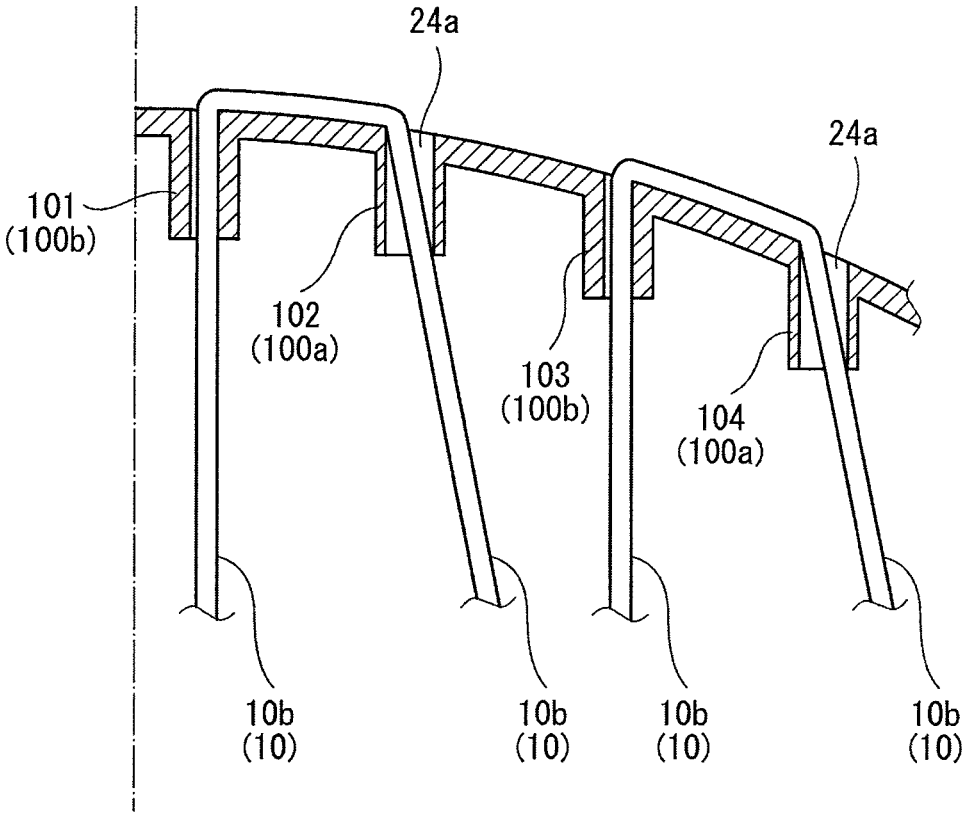
FIG. 10 is a front view of the area near the top in FIG. 8.

By this swing, outward force in the width direction is applied to the longitudinal string 10*b* passed through the second tubular portion 102. The inner dimension in the width direction of the through hole 24*a* of the second tubular portion 102 (100*a*) is sufficiently large. Therefore, the longitudinal string 10*b* becomes deformed without being obstructed by the second tubular portion 102, and moves outward in the width direction. FIG. 10 shows the longitudinal string 10*b* after the movement. Thereafter, the longitudinal string 10*b* returns to the original shape. The longitudinal string 10*b* passed through the fourth tubular portion 104 (100*a*) also similarly becomes deformed and returns to the original shape. The deformation and the return of these longitudinal strings 10*b* achieve a long contact time between the tennis racket 2 and the tennis ball 32. With the tennis racket 2, the tennis ball 32 is launched at a large launch angle. With the tennis racket 2, even when the tennis ball 32 is hit at the lower side with respect to the center line CL, a high trajectory can be obtained.

As described above, the string 10 is in contact with the wall surface, at the inner side in the width direction, of the side wall 28*a* of the through hole 24*a*. Therefore, when the tennis ball 32 collides against the face 17 at the upper side with respect to the center line CL, promotion of deformation of the longitudinal strings 10*b* due to the through holes 24*a*, which have elongated circle shapes, is not achieved. Accordingly, a long contact time is not obtained, and the trajectory is not corrected. With the racket 2, the difference in trajectory is small between when the tennis ball 32 collides against the face 17 at the upper side with respect to the center line CL and when the tennis ball 32 collides against the face 17 at the lower side with respect to the center line CL.

For the purpose of imparting performance intended by a designer to the tennis racket 2, the tubular portion 100*a* may be formed such that the string 10 is in contact with the wall surface at the outer side in the width direction.

In FIG. 8, an arrow W2 indicates the distance in the width direction from the center line CL to the tubular portion 100*a* that is located at the outermost side in the width direction, that has the non-circular tip-side opening 30*a*, and in which the string 10*b* is in contact with the wall surface at the inner side in the width direction. The distance W2 is preferably not less than 15% and not greater than 80%, and particularly preferably not less than 20% and not greater than 70%, of the half width W1 (see FIG. 1) of the tennis racket 2.

In the tennis racket 2, the tubular portions 100*a* (the second tubular portion 102 and the fourth tubular portion 104) located near the top each have the through hole 24*a* with a cross-sectional shape that is non-circular. The tubular portions 100 located at the yoke 18 may each have a through hole 24*a* with a cross-sectional shape that is non-circular. The tubular portions 100 located at the side may each have a through hole 24*a* with a cross-sectional shape that is non-circular. The transverse string 10*a* may be passed through a tubular portion 100 that has a through hole 24*a* with a cross-sectional shape that is non-circular. In any of these cases, improvement of a trajectory height can be achieved when the tennis ball 32 collides against a predetermined area.

In the tennis racket 2, as described above, the second tubular portion 102 and the fourth tubular portion 104 each have the through hole 24*a* with a cross-sectional shape that is non-circular. Since the tennis racket 2 has a symmetrical shape with respect to the center line CL, the tennis racket 2 includes two second tubular portions 102 and two fourth tubular portions 104. Therefore, the total number N of the tubular portions 100*a* that have a through hole 24*a* with a non-circular cross-sectional shape and in which the string 10*b* is in contact with the wall surface at the inner side in the width direction, is four. The total number N is preferably not less than 2 and not greater than 16, and more preferably not less than 4 and not greater than 12.

Figure 11:
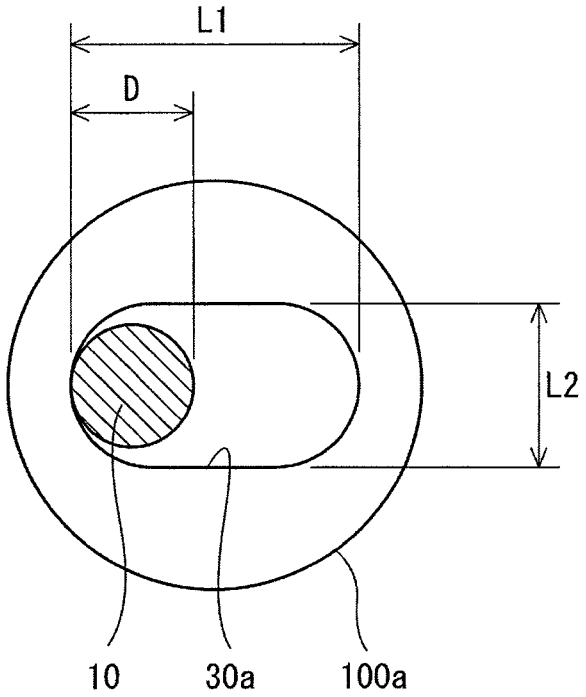
FIG. 11 is a bottom view of a tubular portion of the grommet in FIGS. 5(*a*) and 5(*b*) with the string.

FIG. 11 is a bottom view of the tubular portion 100*a* of the grommet 8 in FIGS. 5(*a*) and 5(*b*). FIG. 11 shows the tip of the tubular portion 100*a*. In FIG. 11, a direction perpendicular to the surface of the sheet is the axial direction of the tubular portion 100*a*. The tubular portion 100*a* has the tip-side opening 30*a*. As described above, the shape of the tip-side opening 30*a* is an elongated circle.

In FIG. 11, an arrow L1 indicates the inner dimension, in the direction parallel to the face 17, of the tip-side opening 30*a*. The inner dimension L1 is also the long diameter of the elongated circle. In FIG. 11, an arrow L2 indicates the inner dimension, in the direction perpendicular to the face 17, of the tip-side opening 30*a*. The inner dimension L2 is also the short diameter of the elongated circle. From the viewpoint that the string 10 easily becomes deformed in the direction parallel to the face 17 and is less likely to become deformed in the direction perpendicular to the face 17, the ratio (L1/L2) is preferably not less than 1.3 and particularly preferably not less than 1.5. The ratio (L1/L2) is preferably not greater than 4.0. L1 is preferably not less than 2.0 mm and not greater than 3.0 mm.

In FIG. 11, an arrow D indicates the diameter of the string 10. From the viewpoint that the string 10 easily becomes deformed in the direction parallel to the face 17, the ratio (L1/D) is preferably not less than 1.5 and particularly preferably not less than 1.8. The ratio (L1/D) is preferably not greater than 4.5.

Second Embodiment

Figure 12:
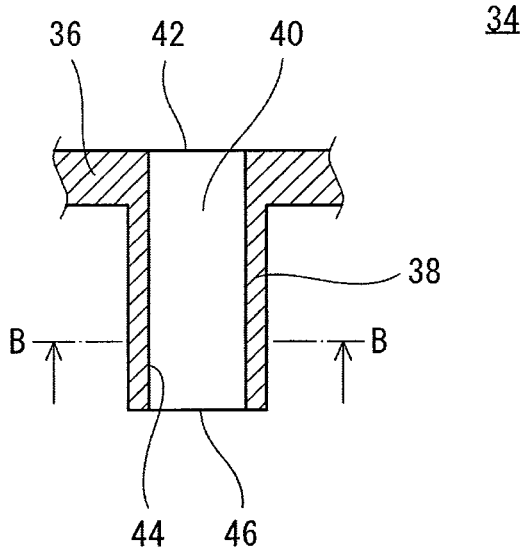
FIG. 12(*a*) is a cross-sectional view of a part of a grommet of a racket according to another embodiment of the present invention.
Figure 12:
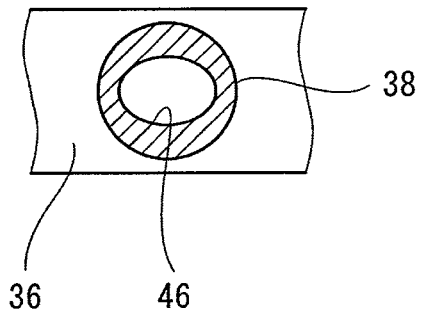

FIG. 12(*a*) is a cross-sectional view of a part of a grommet 34 of a tennis racket according to another embodiment of the present invention, and FIG. 12(*b*) is a cross-sectional view taken along a line B-B in FIG. 12(*a*). The structure of the tennis racket other than the grommet 34 is the same as that of the tennis racket 2 shown in FIGS. 1 to 11.

The grommet 34 includes a base 36 and a tubular portion 38. The tubular portion 38 has a through hole 40. The through hole 40 has a base-side opening 42, a side wall 44, and a tip-side opening 46. As shown in FIG. 12(*b*), the cross-sectional shape of the through hole 40 is an ellipse. The through hole 40 has a uniform cross-sectional shape from the base-side opening 42 to the tip-side opening 46.

Figure 13:
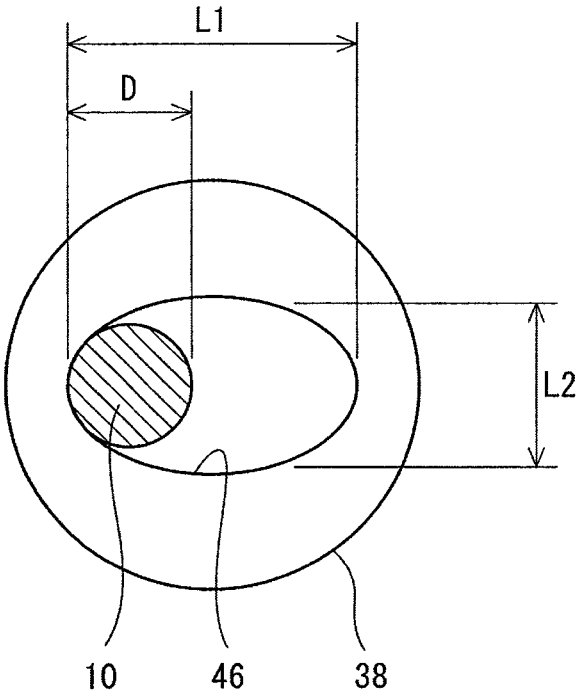
FIG. 13 is a bottom view of a tubular portion of the grommet in FIGS. 12(*a*) and 12(*b*) with a string.

FIG. 13 is a bottom view of the tubular portion 38 of the grommet 34 in FIGS. 12(*a*) and 12(*b*). FIG. 13 shows the tip of the tubular portion 38. FIG. 13 also shows a string 10. In FIG. 13, a direction perpendicular to the surface of the sheet is the axial direction of the tubular portion 38. The shape of the tip-side opening 46 is an ellipse.

In FIG. 13, an arrow L1 indicates the inner dimension, in a direction parallel to a face, of the tip-side opening 46. The inner dimension L1 is also the major diameter of the ellipse. In FIG. 13, an arrow L2 indicates the inner dimension, in a direction perpendicular to the face, of the tip-side opening 46. The inner dimension L2 is also the minor diameter of the ellipse. From the viewpoint that the string 10 easily becomes deformed in the direction parallel to the face and is less likely to become deformed in the direction perpendicular to the face, the ratio (L1/L2) is preferably not less than 1.3 and particularly preferably not less than 1.5. The ratio (L1/L2) is preferably not greater than 4.0. The inner dimension L2 is preferably not less than 1.8 mm and not greater than 2.2 mm.

In FIG. 13, an arrow D indicates the diameter of the string 10. From the viewpoint that the string 10 easily becomes deformed in the direction parallel to the face, the ratio (L1/D) is preferably not less than 1.5 and particularly preferably not less than 1.8. The ratio (L1/D) is preferably not greater than 4.5.

Third Embodiment

Figure 14A:
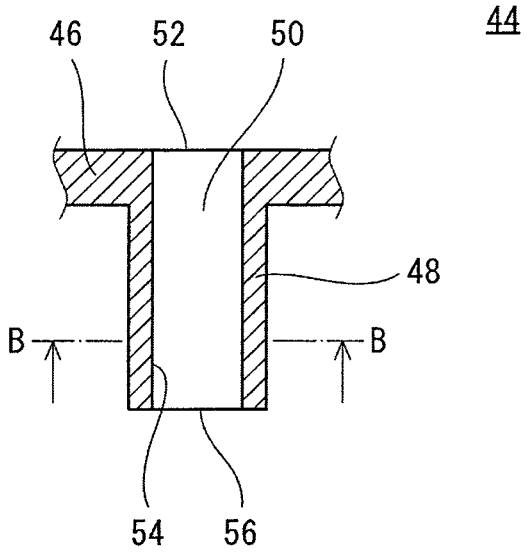
FIG. 14(*a*) is a cross-sectional view of a part of a grommet of a racket according to still another embodiment of the present invention.
Figure 14B:
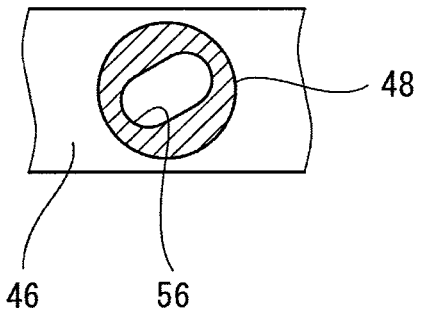

FIG. 14(*a*) is a cross-sectional view of a part of a grommet 44 of a tennis racket according to still another embodiment of the present invention, and FIG. 14(*b*) is a cross-sectional view taken along a line B-B in FIG. 14(*a*). The structure of the tennis racket other than the grommet 44 is the same as that of the tennis racket 2 shown in FIGS. 1 to 11.

The grommet 44 includes a base 46 and a tubular portion 48.

The tubular portion 48 has a through hole 50. The through hole 50 has a base-side opening 52, a side wall 54, and a tip-side opening 56. As shown in FIG. 14(*b*), the cross-sectional shape of the through hole 50 is an elongated circle. The long axis of the elongated circle is tilted relative to a direction parallel to a face. The through hole 50 has a uniform cross-sectional shape from the base-side opening 52 to the tip-side opening 56.

Figure 15:
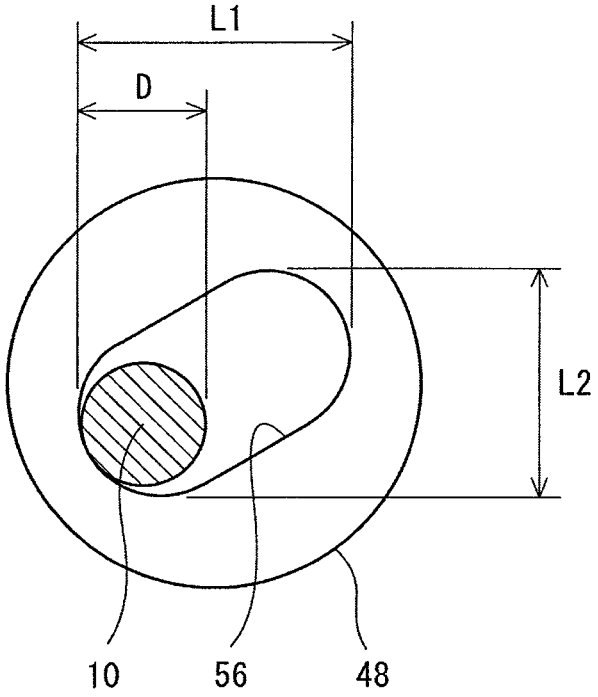
FIG. 15 is a bottom view of a tubular portion of the grommet in FIGS. 14(*a*) and 14(*b*) with a string.

FIG. 15 is a bottom view of the tubular portion 48 of the grommet 44 in FIGS. 14(*a*) and 14(*b*). FIG. 15 shows the tip of the tubular portion 48. FIG. 15 also shows a string 10. In FIG. 15, a direction perpendicular to the surface of the sheet is the axial direction of the tubular portion 48. The shape of the tip-side opening 56 is an elongated circle.

In FIG. 15, an arrow L1 indicates the inner dimension, in the direction parallel to the face, of the tip-side opening 56. In FIG. 15, an arrow L2 indicates the inner dimension, in the direction perpendicular to the face, of the tip-side opening 56. The inner dimension L1 is larger than the inner dimension L2. Therefore, the string 10 can easily move in the through hole 50 in the direction parallel to the face. From the viewpoint that the string 10 easily becomes deformed in the direction parallel to the face and is less likely to become deformed in the direction perpendicular to the face, the ratio (L1/L2) is preferably not less than 1.3 and particularly preferably not less than 1.5. The ratio (L1/L2) is preferably not greater than 4.0.

In FIG. 15, an arrow D indicates the diameter of the string 10. From the viewpoint that the string 10 easily becomes deformed in the direction parallel to the face, the ratio (L1/D) is preferably not less than 1.5 and particularly preferably not less than 1.8. The ratio (L1/D) is preferably not greater than 4.5.

Fourth Embodiment

Figure 16:
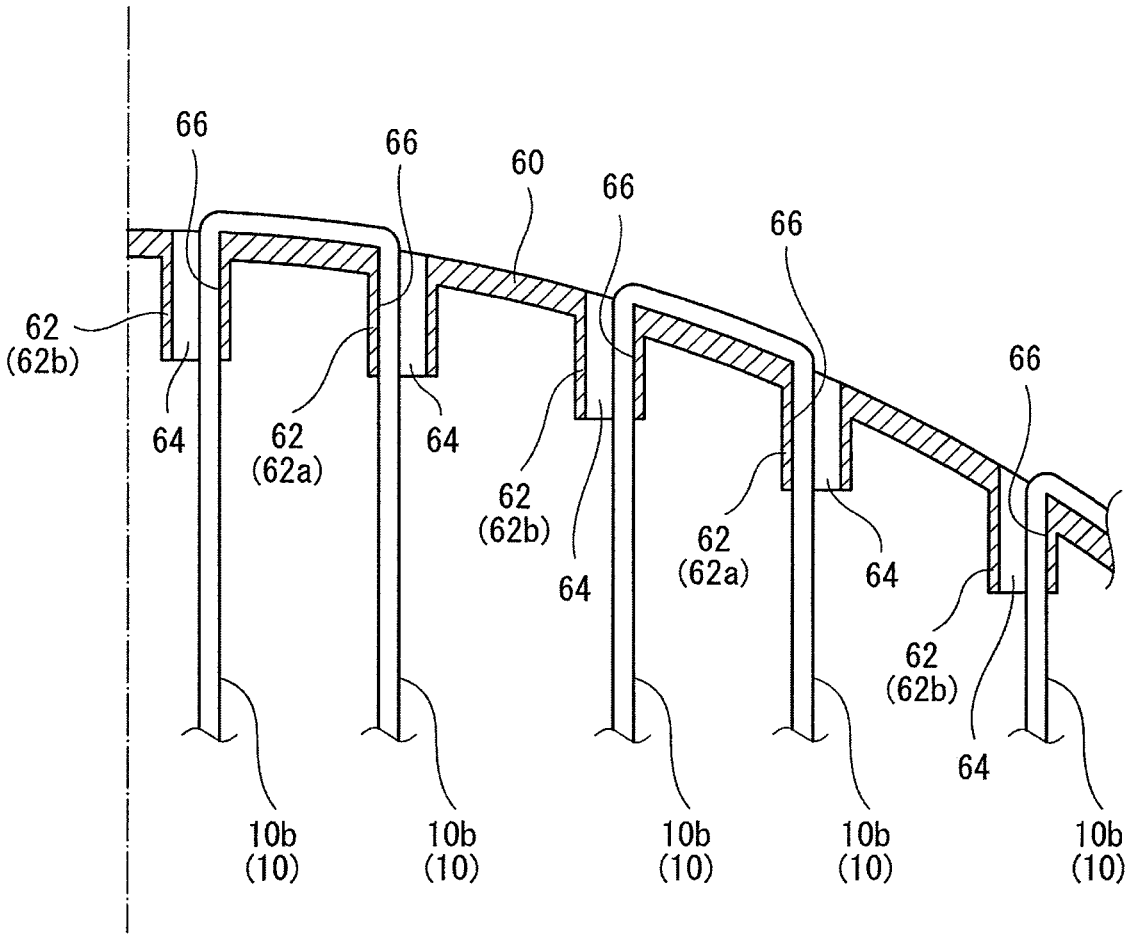
FIG. 16 is an enlarged view of an area near the top of a racket according to still another embodiment of the present invention.

FIG. 16 is an enlarged view of an area near the top of a racket according to still another embodiment of the present invention. In FIG. 16, a frame and transverse strings 10*a* are not shown. FIG. 16 shows a base 60 and five tubular portions 62. Each tubular portion 62 has a through hole 64 with a cross-sectional shape that is an elongated circle. The long axis of the elongated circle coincides with the width direction of the racket (the right-left direction in FIG. 16). The through hole has a side wall 66.

As is obvious from FIG. 16, the racket has first tubular portions 62*a* in each of which a longitudinal string 10*b* is in contact with the wall surface, at the inner side in the width direction (the left side in FIG. 16), of a side wall 66, and second tubular portions 62*b* in each of which a longitudinal string 10*b* is in contact with the wall surface, at the outer side in the width direction (the right side in FIG. 16), of a side wall 66. The longitudinal strings 10*b* passed through the first tubular portions 62*a* can sufficiently become deformed outward in the width direction. The longitudinal strings 10*b* passed through the second tubular portions 62*b* can sufficiently become deformed inward in the width direction.

Still Another Embodiment

In a tubular portion that mainly permits movement of a string in a direction parallel to a face, various shapes can be used for a tip-side opening. In the tip-side opening having any of the various shapes, the inner dimension L1 in the direction parallel to the face is larger than the inner dimension L2 in a direction perpendicular to the face. The ratio (L1/L2) is preferably not less than 1.3 and particularly preferably not less than 1.5. The ratio (L1/L2) is preferably not greater than 4.0.

Second Invention

First Embodiment

Figure 17:
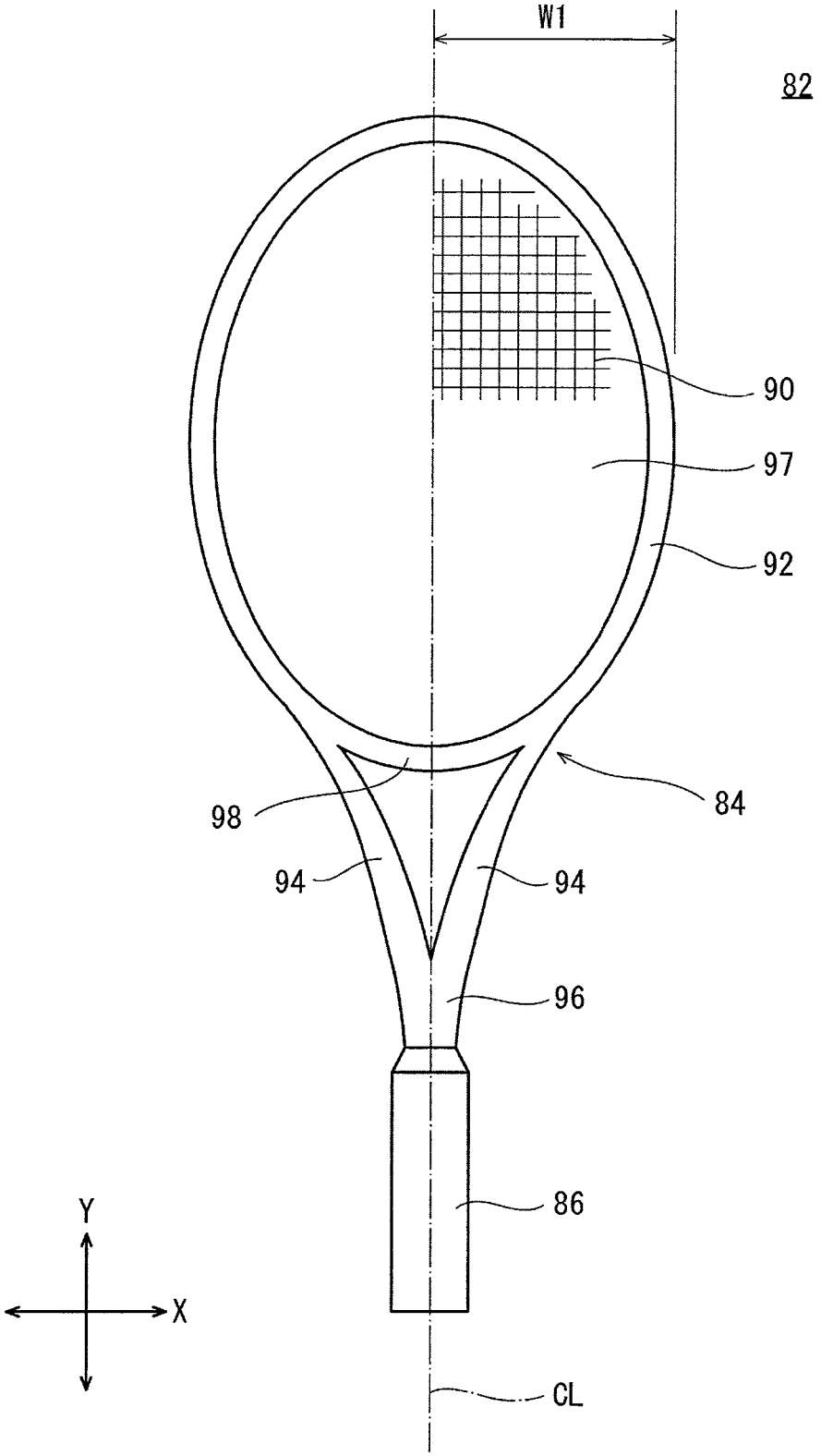
FIG. 17 is a front view of a racket according to still another embodiment of the present invention.
Figure 18:
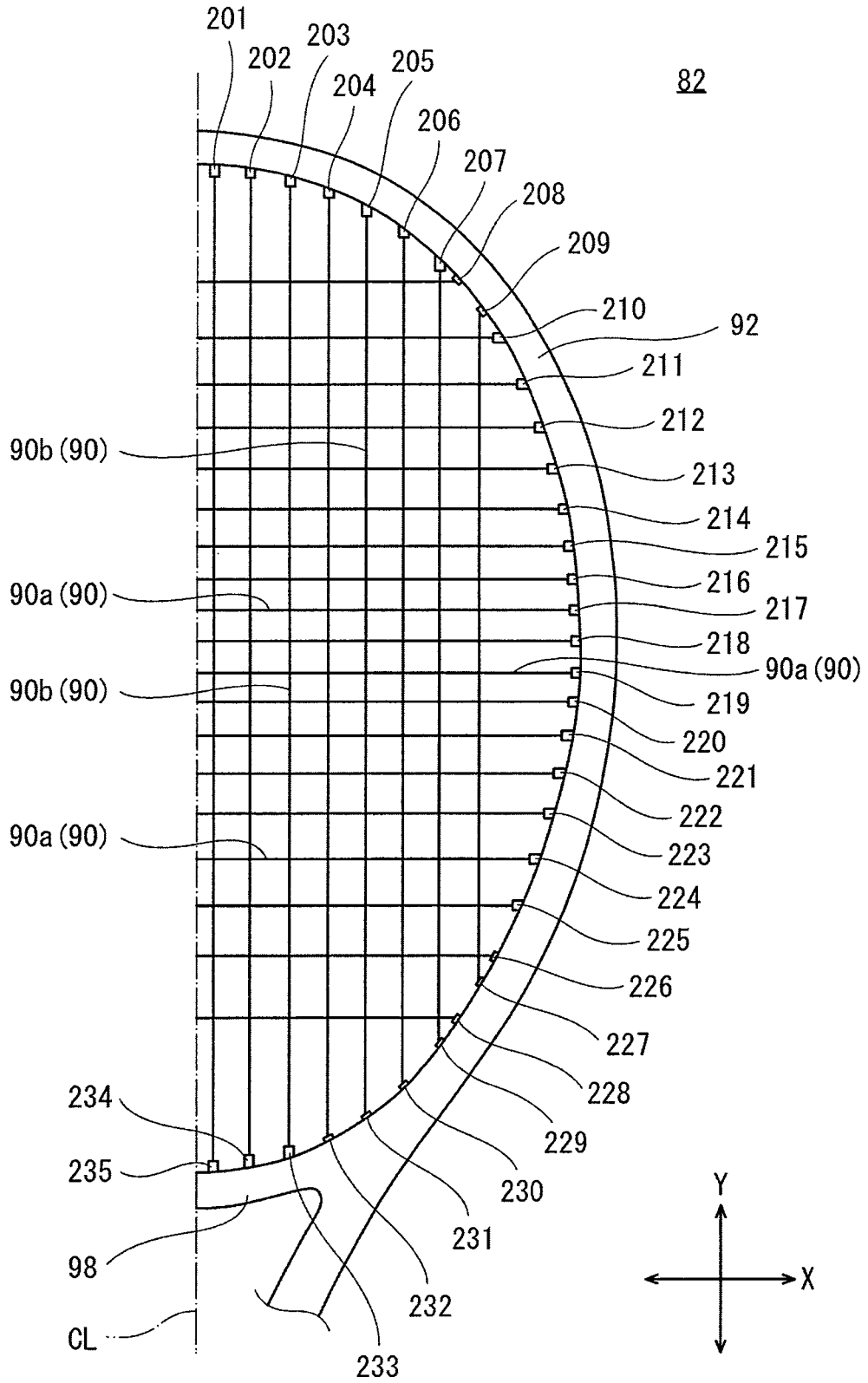
FIG. 18 is an enlarged view of a part of the racket in FIG. 17.

FIGS. 17 to 20 show a tennis racket 82. The tennis racket 82 includes a frame 84, a grip 86, grommets 88, and a string 90. The tennis racket 82 can be used in regulation-ball tennis. In FIGS. 17 and 18, an arrow X represents the width direction of the tennis racket 82, and an arrow Y represents the axial direction of the tennis racket 82.

The frame 84 includes a head 92, two throats 94, and a shaft 96. The head 92 forms the contour of a face 97 (described in detail later). The front shape of the head 92 is substantially an ellipse. The major axis direction of the ellipse coincides with the axial direction Y of the tennis racket 82. The minor axis direction of the ellipse coincides with the width direction X of the tennis racket 82. One end of each throat 94 is connected to the head 92. The throat 94 is connected at the vicinity of the other end thereof to the other throat 94. The throats 94 extend from the head 92 to the shaft 96. The shaft 96 extends from the location where the two throats 94 are connected to each other. The shaft 96 is formed so as to be integrally connected to the throats 94. A portion, of the head 92, located between the two throats 94 is a yoke 98.

The frame 84 is composed of a pipe. In other words, the frame 84 is hollow. The material of the pipe is a fiber-reinforced resin. The matrix resin of the fiber-reinforced resin is a thermosetting resin. A typical thermosetting resin is an epoxy resin. Typical fibers of the fiber-reinforced resin are carbon fibers. The fibers are long fibers.

The grip 86 is formed by a tape wound on the shaft 96. The grip 86 suppresses slip between a hand of a player and the tennis racket 82 when the tennis racket 82 is swung.

Figure 19:
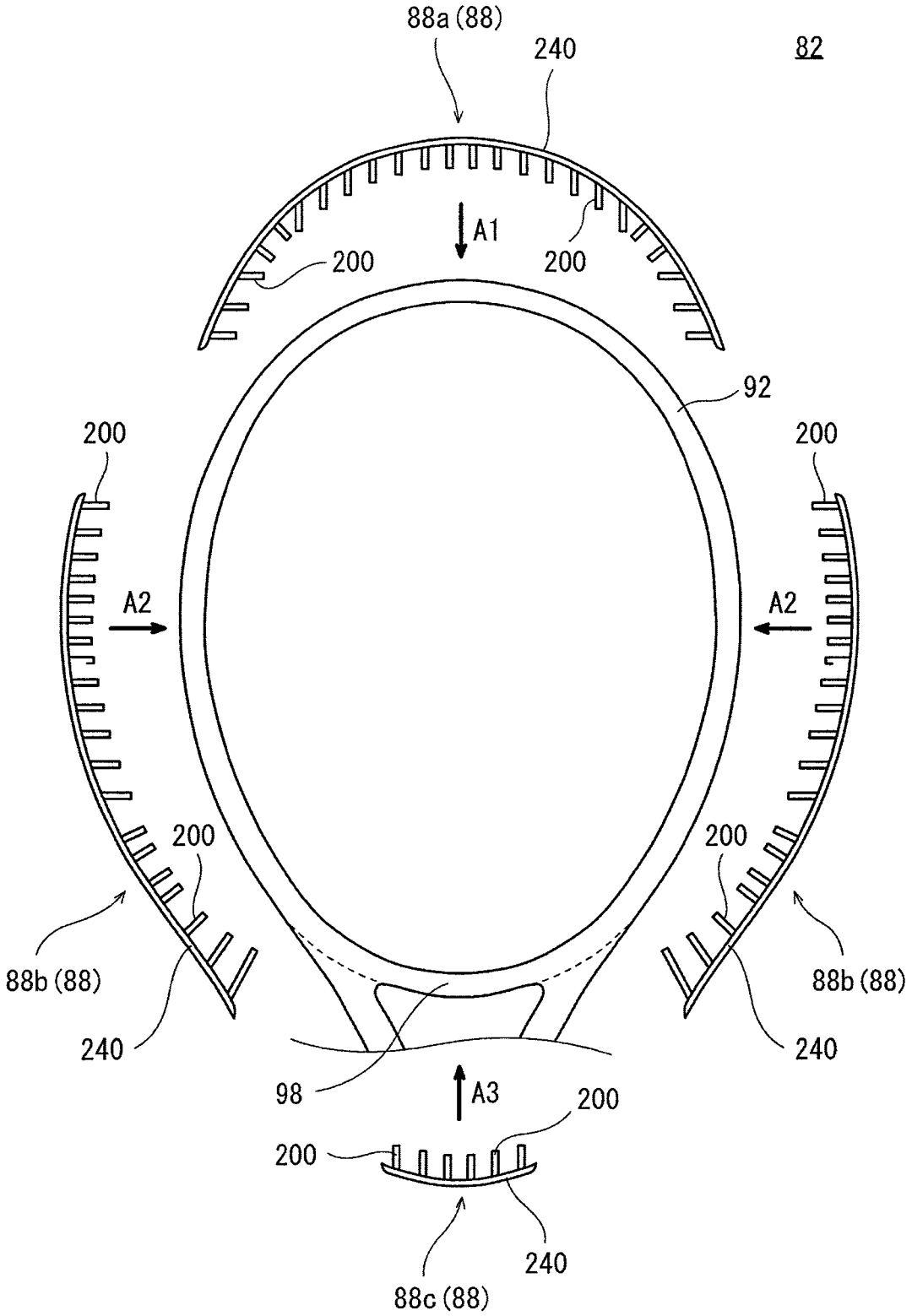
FIG. 19 is an exploded view of a part of the racket in FIG. 17.

As shown in FIG. 19, the tennis racket 82 includes a first grommet 98*a*, two second grommets 88*b*, and a third grommet 98*c*. Each grommet 98 includes a base 240 and a plurality of tubular portions 200. Each tubular portion 200 is formed so as to be integrated with the base 240. A typical material of the grommet 98 is a synthetic resin that is more flexible than the frame 84.

The first grommet 98*a* is mounted onto a portion at and near the top of the head 92 as shown by an arrow A1 in FIG. 19. As a result of the mounting, each tubular portion 200 of the first grommet 98*a* penetrates a hole (not shown) provided in the head 92. Each second grommet 98*b* is mounted onto a side of the head 92 as shown by an arrow A2 in FIG. 19. As a result of the mounting, each tubular portion 200 of the second grommet 98*b* penetrates a hole (not shown) provided in the head 92. The third grommet 98*c* is mounted onto the yoke 98 as shown by an arrow A3 in FIG. 19. As a result of the mounting, each tubular portion 200 of the third grommet 98*c* penetrates a hole (not shown) provided in the head 92.

The string 90 is stretched on the head 92. The string 90 is stretched along the width direction X and the axial direction Y. Of the string 90, portions extending along the width direction X are referred to as transverse strings 90*a*. Of the string 90, portions extending along the axial direction Y are referred to as longitudinal strings 90*b*. The face 97 (see FIG. 17) is formed by a plurality of transverse strings 90*a* and a plurality of longitudinal strings 90*b*. The face 97 generally extends along an X-Y plane.

Figure 20:
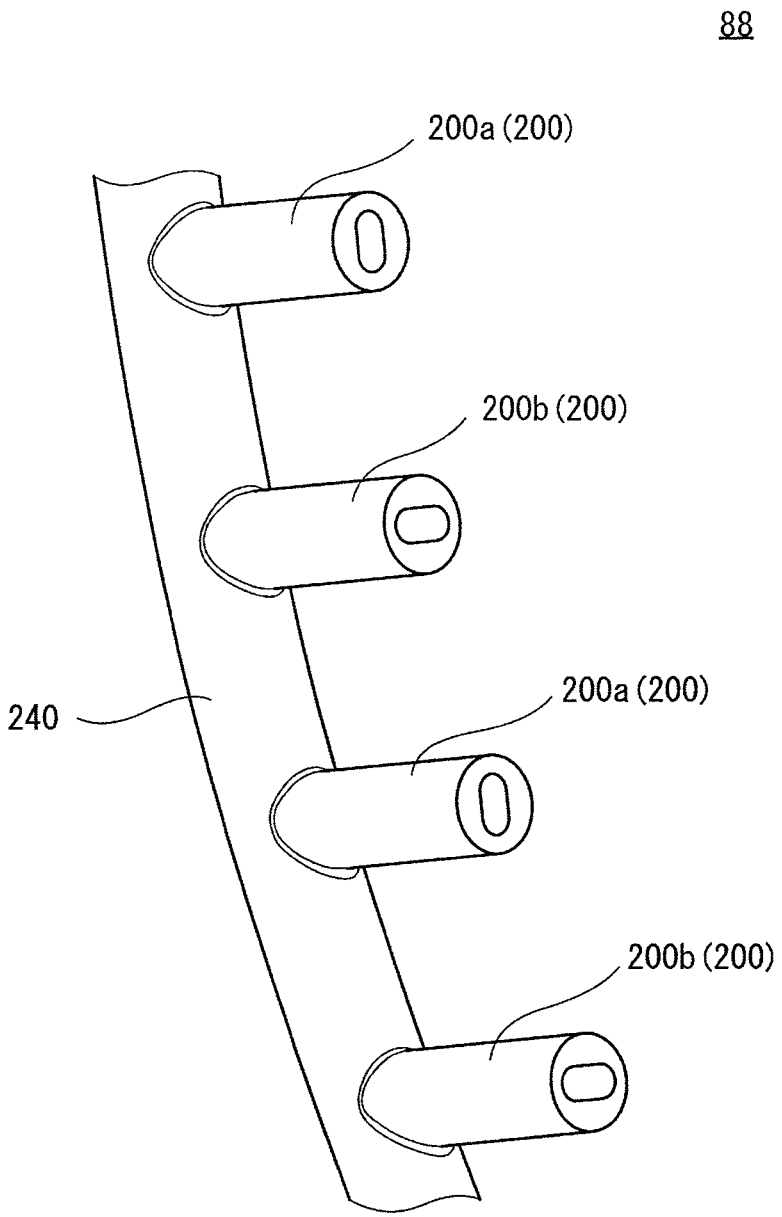
FIG. 20 is an enlarged view of a part of a grommet of the tennis racket in FIG. 19.

FIG. 20 is an enlarged view of a part of the grommet 98 of the tennis racket 82 in FIG. 19. As described above, the grommet 98 includes the base 240 and the plurality of tubular portions 200. These tubular portions 200 include parallel movement tubular portions 200*a* and vertical movement tubular portions 200*b*. These tubular portions 200 can also include tubular portions 200 other than the parallel movement tubular portions 200*a* and the vertical movement tubular portions 200*b*.

Figure 21B:
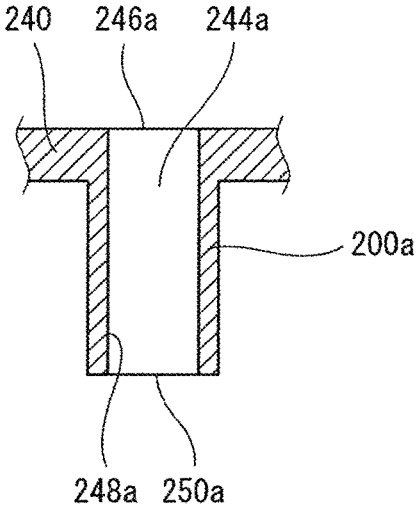
FIG. 21(*a*) is a front view of a part of the grommet in FIG. 20.
Figure 21A:
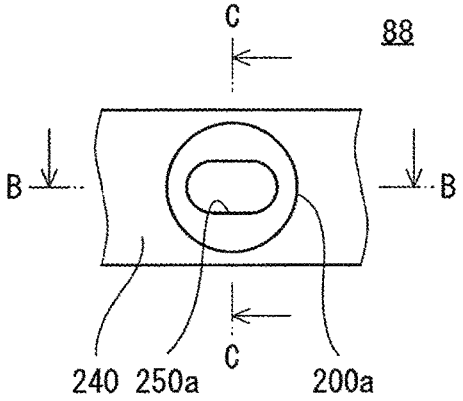
Figure 21C:
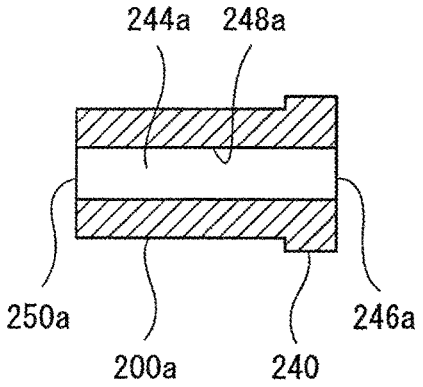

FIG. 21(*a*) is a front view of a part of the grommet 98 in FIG. 20, FIG. 21(*b*) is a cross-sectional view taken along a line B-B in FIG. 21(*a*), and FIG. 21(*c*) is a cross-sectional view taken along a line C-C in FIG. 21(*a*). FIGS. 21(*a*) to 21(*c*) show a parallel movement tubular portion 200*a*. The parallel movement tubular portion 200*a* has a through hole 244*a*. The through hole 244*a* has a base-side opening 246*a*, a side wall 248*a*, and a tip-side opening 250*a*. The cross-sectional shape of the through hole 244*a* is an elongated circle. The through hole 244*a* has a uniform cross-sectional shape from the base-side opening 246*a* to the tip-side opening 250*a*. In the through hole 244*a*, the inner dimension in a direction parallel to the face 97 (the right-left direction in FIG. 21(*a*)) is larger than the inner dimension in a direction perpendicular to the face 97 (the up-down direction in FIG. 21(*a*)).

Figure 22B:
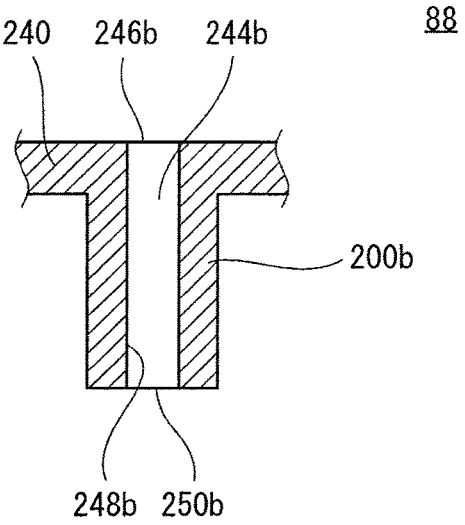
FIG. 22(*a*) is a front view of a part of the grommet in FIG. 20.
Figure 22A:
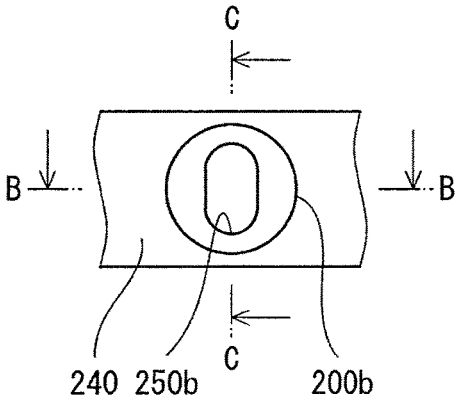
Figure 22C:
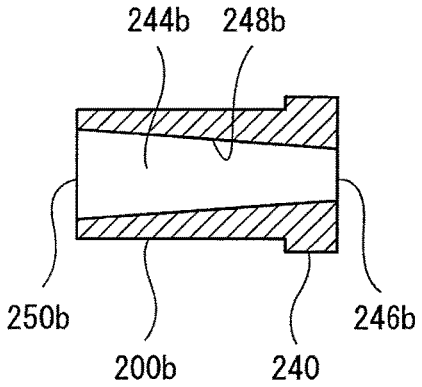

FIG. 22(*a*) is a front view of a part of the grommet 98 in FIG. 20, FIG. 22(*b*) is a cross-sectional view taken along a line B-B in FIG. 22(*a*), and FIG. 22(*c*) is a cross-sectional view taken along a line C-C in FIG. 22(*a*). FIGS. 22(*a*) to 22(*c*) show a vertical movement tubular portion 200*b*. The vertical movement tubular portion 200*b* has a through hole 244*b*. The through hole 244*b* has a base-side opening 246*b*, a side wall 248*b*, and a tip-side opening 250*b*. In the through hole 244*b*, the inner dimension in the direction parallel to the face 97 (the right-left direction in FIG. 22(*a*)) is uniform from the base-side opening 246*b* to the tip-side opening 250*b*. The inner dimension in the direction perpendicular to the face 97 (the up-down direction in FIG. 22(*a*)) gradually increases from the base-side opening 246*b* toward the tip-side opening 250*b*. The shape of the base-side opening 246*b* is generally a circle. The shape of the tip-side opening 250*b* is an elongated circle. In the tip-side opening 250*b*, the inner dimension in the direction perpendicular to the face 97 is larger than the inner dimension in the direction parallel to the face 97.

Figure 23A:
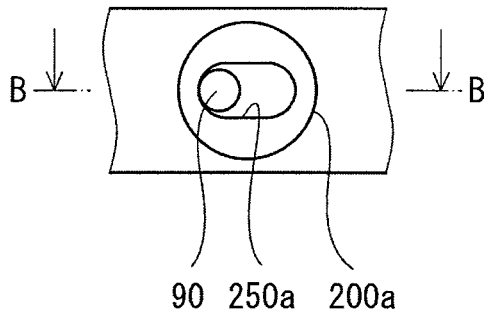
FIG. 23(*a*) is a front view of the grommet in FIGS. 21(*a*) to 21(*c*) with a string.
Figure 23B:
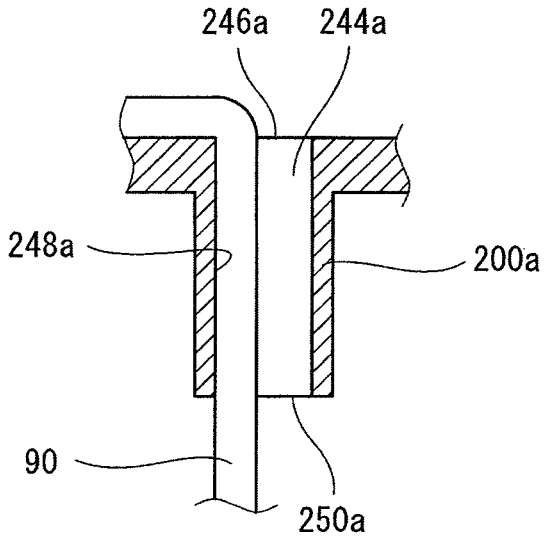

FIG. 23(*a*) is a front view of the grommet 98 in FIGS. 21(*a*) to 21(*c*) with the string 90, and FIG. 23(*b*) is a cross-sectional view taken along a B-B in FIG. 23(*a*). The string 90 is passed through the through hole 244*a*. The string 90 is in contact with the side wall 248*a* from the base-side opening 246*a* to the tip-side opening 250*a*. The string 90 is in contact with a left side wall surface of the side wall 248*a*. Since the inner dimension in the right-left direction of the base-side opening 246*a* is equal to the inner dimension in the right-left direction of the tip-side opening 250*a*, the string 90 can be in contact with the side wall 248*a* from the base-side opening 246*a* to the tip-side opening 250*a*. As is obvious from FIG. 23(*a*), the inner dimension in the right-left direction of the through hole 244*a* is sufficiently larger than the diameter of the string 90. Therefore, the string 90 can move rightward in the parallel movement tubular portion 200*a*. The string 90 can hardly move in the up-down direction in the parallel movement tubular portion 200*a*. In other words, the parallel movement tubular portion 200*a* mainly permits movement of the string 90 in the direction parallel to the face 97.

Figure 24A:
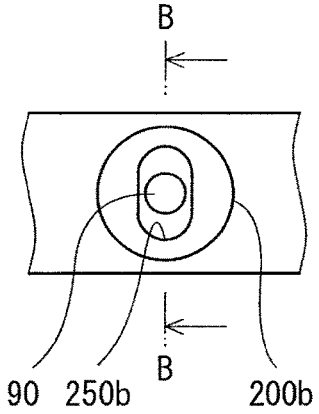
FIG. 24(*a*) is a front view of the grommet in FIGS. 22(*a*) to 22(*c*) with the string.
Figure 24B:
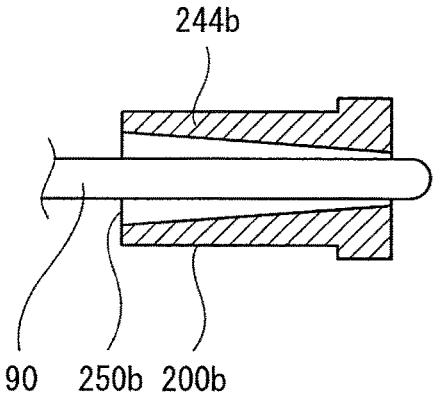

FIG. 24(*a*) is a front view of the grommet 98 in FIGS. 22(*a*) to 22(*c*) with the string 90, and FIG. 24(*b*) is a cross-sectional view taken along a line B-B in FIG. 24(*a*). The string 90 is passed through the through hole 244*b*. The string 90 extends so as to substantially coincide with the axis of the through hole 244*b*. As is obvious from FIG. 24(*a*), the inner dimension in the up-down direction of the tip-side opening 250*b* is sufficiently larger than the diameter of the string 90. Therefore, the string 90 can move in the up-down direction in the vertical movement tubular portion 200*b*. The string 90 can hardly move in the right-left direction in the vertical movement tubular portion 200*b*. In other words, the vertical movement tubular portion 200*b* mainly permits movement of the string 90 in the direction perpendicular to the face 97.

In FIG. 18, reference character CL indicates a center line. The tennis racket 82 has a symmetrical shape with respect to the center line CL. As shown in FIG. 18, the tennis racket 82 includes a first tubular portion 201, a second tubular portion 202, a third tubular portion 203, a fourth tubular portion 204, a fifth tubular portion 205, a sixth tubular portion 206, a seventh tubular portion 207, an eighth tubular portion 208, a ninth tubular portion 209, a tenth tubular portion 210, an eleventh tubular portion 211, a twelfth tubular portion 212, a thirteenth tubular portion 213, a fourteenth tubular portion 214, a fifteenth tubular portion 215, a sixteenth tubular portion 216, a seventeenth tubular portion 217, an eighteenth tubular portion 218, a nineteenth tubular portion 219, a twentieth tubular portion 220, a twenty-first tubular portion 221, a twenty-second tubular portion 222, a twenty-third tubular portion 223, a twenty-fourth tubular portion 224, a twenty-fifth tubular portion 225, a twenty-sixth tubular portion 226, a twenty-seventh tubular portion 227, a twenty-eighth tubular portion 228, a twenty-ninth tubular portion 229, a thirtieth tubular portion 230, a thirty-first tubular portion 231, a thirty-second tubular portion 232, a thirty-third tubular portion 233, a thirty-fourth tubular portion 234, and a thirty-fifth tubular portion 235. FIG. 18 shows 35 tubular portions 200. Since the tennis racket 82 has a symmetrical shape with respect to the center line CL as described above, the number of tubular portions 200 in the tennis racket 82 is 70.

As shown in FIG. 18, the longitudinal strings 90*b* are passed through the first tubular portion 201, the second tubular portion 202, the third tubular portion 203, the fourth tubular portion 204, the fifth tubular portion 205, the sixth tubular portion 206, the seventh tubular portion 207, the ninth tubular portion 209, the twenty-seventh tubular portion 227, the twenty-ninth tubular portion 229, the thirtieth tubular portion 230, the thirty-first tubular portion 231, the thirty-second tubular portion 232, the thirty-third tubular portion 233, the thirty-fourth tubular portion 234, and the thirty-fifth tubular portion 235. The transverse strings 90*a* are passed through the eighth tubular portion 208, the tenth tubular portion 210, the eleventh tubular portion 211, the twelfth tubular portion 212, the thirteenth tubular portion 213, the fourteenth tubular portion 214, the fifteenth tubular portion 215, the sixteenth tubular portion 216, the seventeenth tubular portion 217, the eighteenth tubular portion 218, the nineteenth tubular portion 219, the twentieth tubular portion 220, the twenty-first tubular portion 221, the twenty-second tubular portion 222, the twenty-third tubular portion 223, the twenty-fourth tubular portion 224, the twenty-fifth tubular portion 225, the twenty-sixth tubular portion 226, and the twenty-eighth tubular portion 228.

Figure 25:
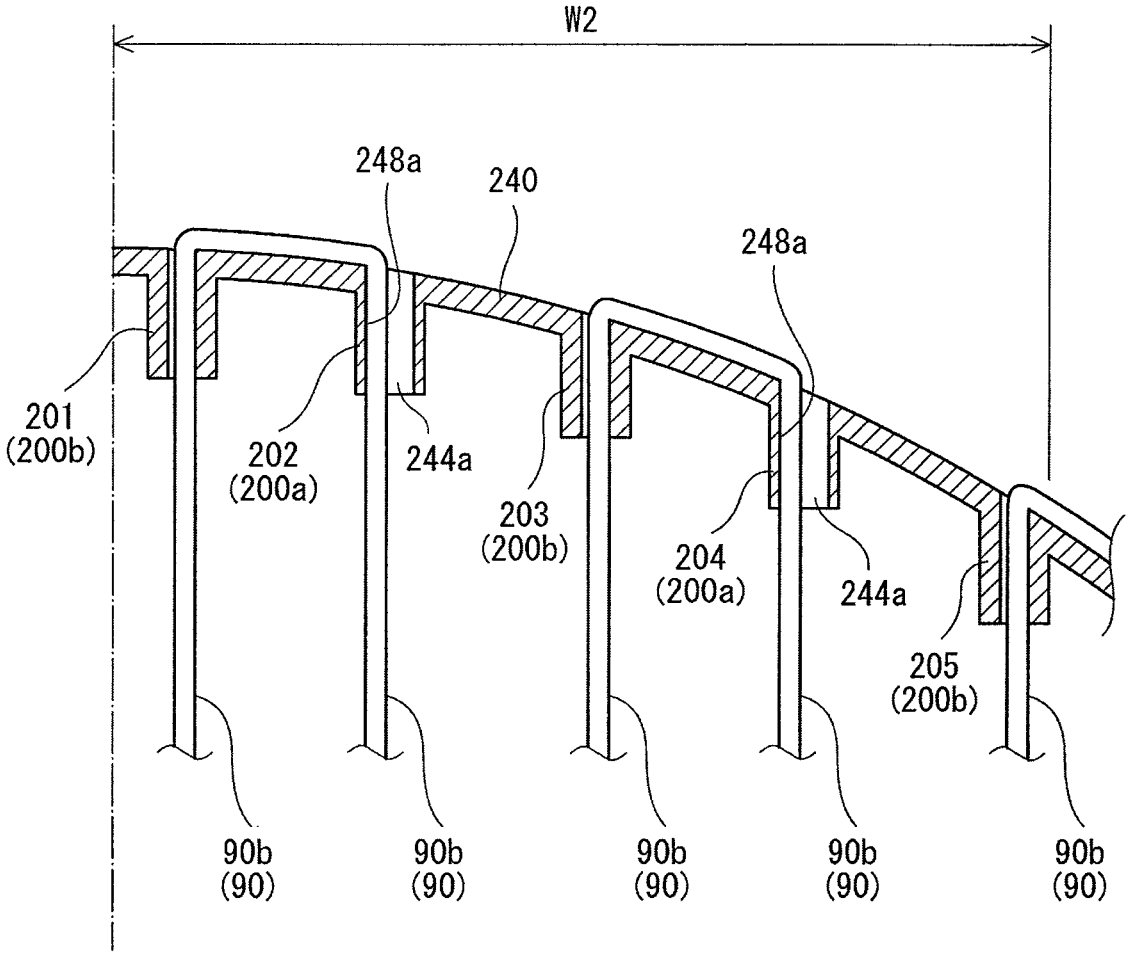
FIG. 25 is an enlarged view of an area near the top of the racket in FIG. 17.

FIG. 25 is an enlarged view of an area near the top of the tennis racket 82 in FIG. 17. In FIG. 25, the frame 84 and the transverse strings 90*a* are not shown. FIG. 25 shows the base 240, the first tubular portion 201, the second tubular portion 202, the third tubular portion 203, the fourth tubular portion 204, and the fifth tubular portion 205. In the present embodiment, the first tubular portion 201, the third tubular portion 203, and the fifth tubular portion 205 are vertical movement tubular portions 200*b*. In each vertical movement tubular portion 200*b*, the shape of the tip-side opening 250*b* is a vertically elongated circle (see FIGS. 22(*a*) to 22(*c*)). The second tubular portion 202 and the fourth tubular portion 204 are parallel movement tubular portions 200*a*. In each parallel movement tubular portion 200*a*, the shape of the tip-side opening 250*a* is a horizontally elongated circle (see FIGS. 21(*a*) to 21(*c*)). In the tennis racket 82, a plurality of parallel movement tubular portions 200*a* and a plurality of vertical movement tubular portions 200*b* are alternately arranged. Each of the parallel movement tubular portions 200*a* is adjacent to at least one vertical movement tubular portion 200*b*. Each of the vertical movement tubular portions 200*b* is adjacent to at least one parallel movement tubular portion 200*a*.

As shown in FIG. 25, in the second tubular portion 202, the longitudinal string 90*b* is in contact with the wall surface, at the left side (the inner side in the width direction), of the side wall 248*a* of the through hole 244*a*. In the fourth tubular portion 204, the longitudinal string 90*b* is in contact with the wall surface, at the left side (the inner side in the width direction), of the side wall 248*a* of the through hole 244*a*.

Figure 26:
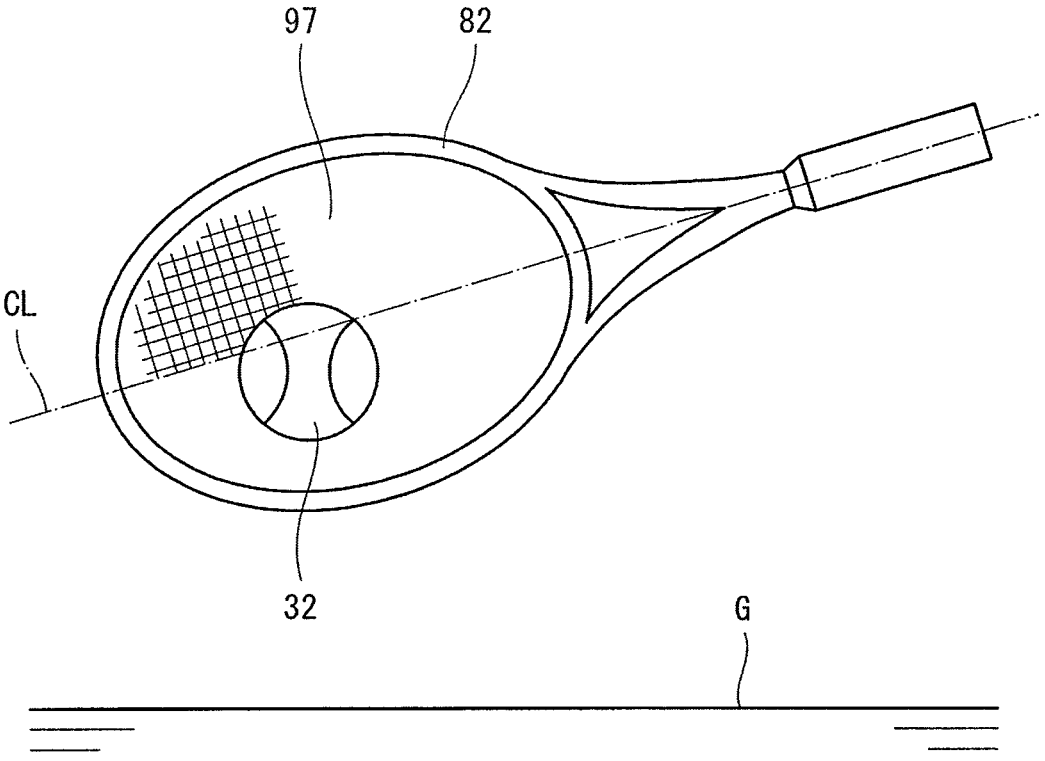
FIG. 26 is a front view of the racket in FIG. 17 with a tennis ball.

FIG. 26 shows a tennis ball 32 together with the tennis racket 82. FIG. 26 shows the moment of impact between the tennis racket 82 and the tennis ball 32. In FIG. 26, the tennis ball 32 collides against the face 97 at the lower side (the ground G side) with respect to the center line CL. In this state, the player swings the tennis racket 82 forward and then upward. This swing is a drive swing.

Figure 27:
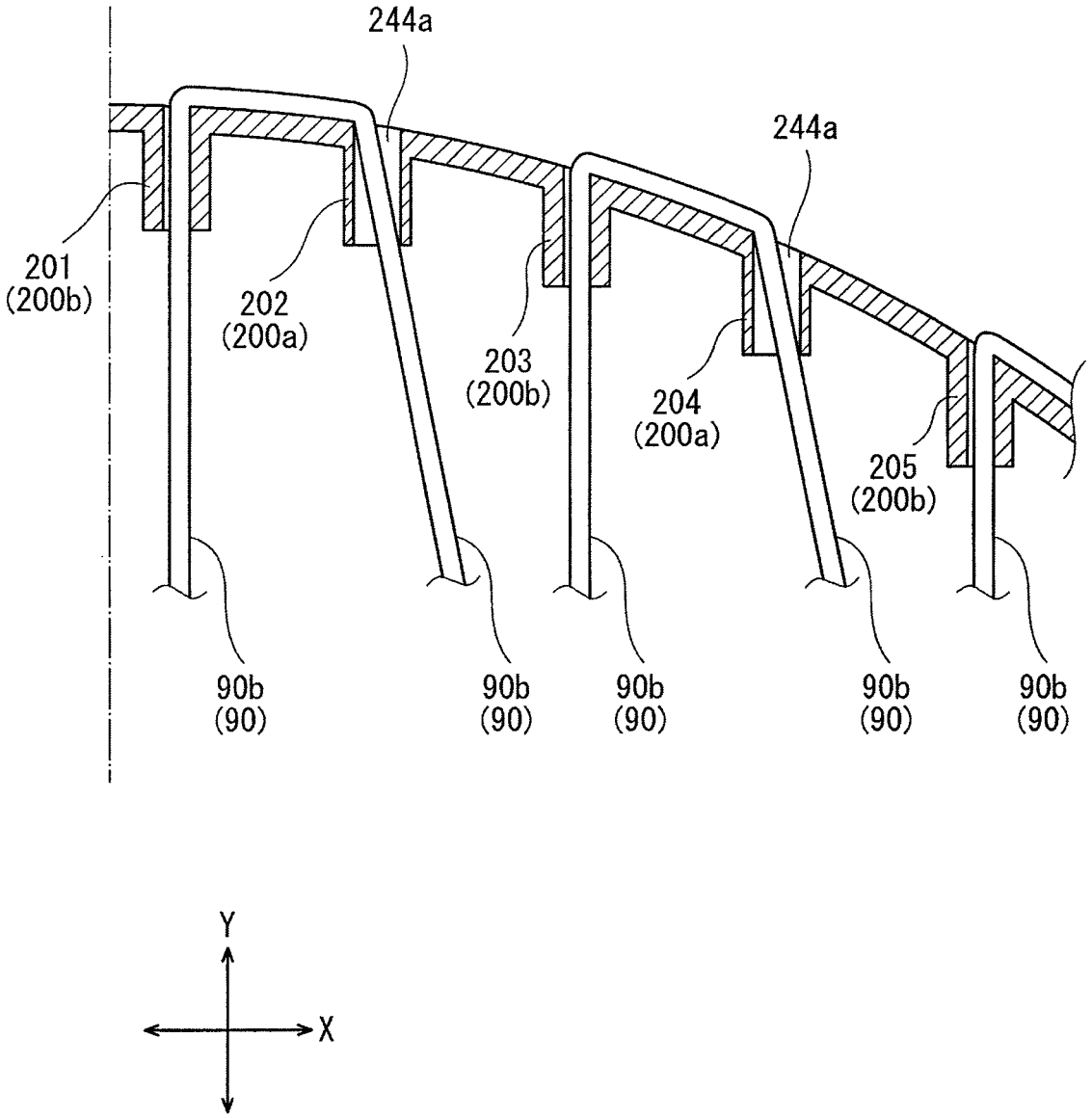
FIG. 27 is a front view showing another state of the area near the top in FIG. 25.

By this swing, outward force in the width direction is applied to the longitudinal string 90*b* passed through the second tubular portion 202. The inner dimension in the width direction of the through hole 244*a* of the second tubular portion 202 is sufficiently large. Therefore, the longitudinal string 90*b* becomes deformed without being obstructed by the second tubular portion 202, and moves outward in the width direction. FIG. 27 shows the longitudinal string 90*b* after the movement. Thereafter, the longitudinal string 90*b* returns to the original shape. The longitudinal string 90*b* passed through the fourth tubular portion 204 also similarly becomes deformed and returns to the original shape. The deformation and the return of these longitudinal strings 90*b* achieve a long contact time between the tennis racket 82 and the tennis ball 32. The tennis ball 32 is launched with a high spin rate.

Figure 28:
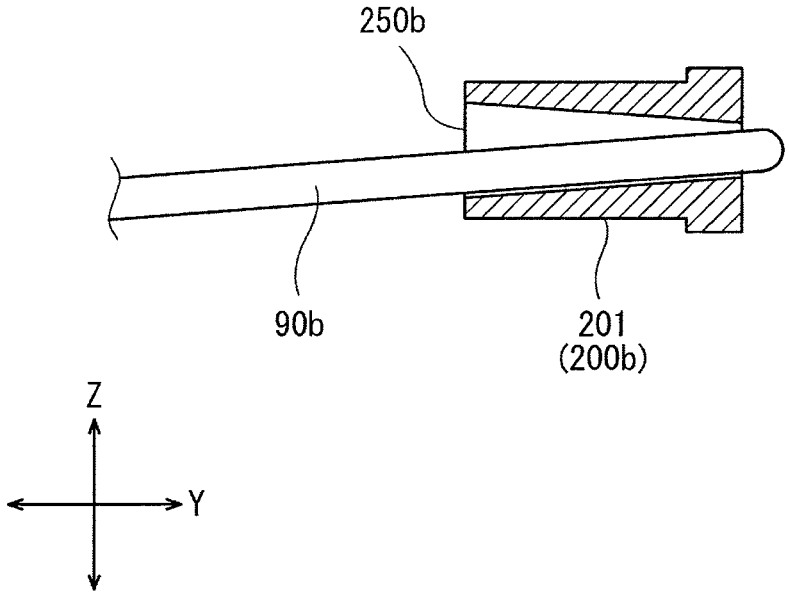
FIG. 28 is a cross-sectional view of a first tubular portion of the racket in FIG. 17.

FIG. 28 is a cross-sectional view of the first tubular portion 201 of the racket in FIG. 17. In FIG. 28, an arrow Z represents the thickness direction of the tennis racket 82. As described above, in the first tubular portion 201, the shape of the tip-side opening 250*b* is a vertically elongated circle. Therefore, the longitudinal string 90*b* passed through the first tubular portion 201 becomes deformed in the Z direction upon reception of pressure from the tennis ball 32. This deformation is not inhibited by the first tubular portion 201. Therefore, the longitudinal string 90*b* can become sufficiently deformed in the Z direction. FIG. 28 shows the longitudinal string 90*b* after the deformation. Thereafter, the longitudinal string 90*b* returns to the original shape. The longitudinal string 90*b* passed through the third tubular portion 203 and the longitudinal string 90*b* passed through the fifth tubular portion 205 can also similarly become sufficiently deformed in the Z direction.

In the parallel movement tubular portion 200*a* (the second tubular portion 202 or the fourth tubular portion 204), as described above, the shape of the tip-side opening 250*b* is a horizontally elongated circle. Therefore, the parallel movement tubular portion 200*a* inhibits movement of the longitudinal strings 90*b* in the Z direction. The longitudinal string 90*b* passed through the parallel movement tubular portion 200*a* does not become sufficiently deformed in the Z direction.

Upon impact between the tennis racket 82 and the tennis ball 32, the amount of deformation in the Z direction of the longitudinal string 90*b* passed through the parallel movement tubular portion 200*a* is small, and the amount of deformation in the Z direction of the longitudinal string 90*b* passed through the vertical movement tubular portion 200*b* is large. In other words, by the impact, only the longitudinal string 90*b* passed through the vertical movement tubular portion 200*b* is greatly moved back. The longitudinal string 90*b* passed through the parallel movement tubular portion 200*a* is not greatly moved back. The longitudinal string 90*b* passed through the parallel movement tubular portion 200*a* sufficiently bites into the tennis ball 32 upon impact. Through the biting, high-rate spin is imparted to the tennis ball 32.

In FIG. 25, an arrow W2 indicates the width of a zone near the top. The parallel movement tubular portions 200*a* and the vertical movement tubular portions 200*b* are preferably disposed in the zone near the top. The width W2 is preferably not less than 15% and not greater than 60%, and particularly preferably not less than 20% and not greater than 50%, of the half width W1 (see FIG. 17) of the tennis racket 82.

For the purpose of imparting performance intended by a designer to the tennis racket 82, the tubular portion 200 may be formed such that the string 90 is in contact with the wall surface at the outer side in the width direction.

The tennis racket 82 has the parallel movement tubular portions 200*a* and the vertical movement tubular portions 200*b* near the top. The tennis racket 82 may have a parallel movement tubular portion 200*a* and a vertical movement tubular portion 200*b* at the yoke 98. The tennis racket 82 may have a parallel movement tubular portion 200*a* and a vertical movement tubular portion 200*b* at each side.

In the tennis racket 82, as described above, the second tubular portion 202 and the fourth tubular portion 204 are parallel movement tubular portions 200*a*. Since the tennis racket 82 has a symmetrical shape with respect to the center line CL, the tennis racket 82 includes two second tubular portions 202 and two fourth tubular portions 204. Therefore, the total number N1 of the parallel movement tubular portions 200*a* is four. The total number N1 is preferably not less than 2 and not greater than 16, and more preferably not less than 4 and not greater than 12.

In the tennis racket 82, as described above, the first tubular portion 201, the third tubular portion 203, and the fifth tubular portion 205 are vertical movement tubular portions 200*b*. Since the tennis racket 82 has a symmetrical shape with respect to the center line CL, the tennis racket 82 includes two first tubular portions 201, two third tubular portions 203, and two fifth tubular portions 205. Therefore, the total number N2 of the vertical movement tubular portions 200*b* is six. The total number N2 is preferably not less than 2 and not greater than 16, and more preferably not less than 4 and not greater than 12.

Figure 29:
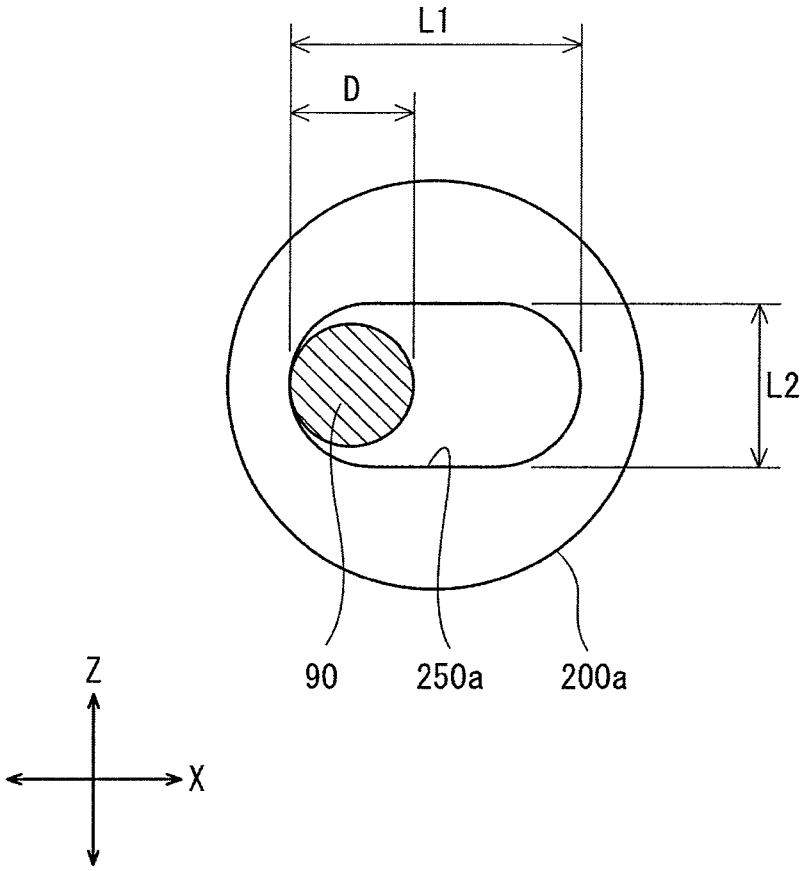
FIG. 29 is a bottom view of a parallel movement tubular portion in FIGS. 21(*a*) to 21(*c*) with the string.

FIG. 29 is a bottom view of the parallel movement tubular portion 200*a* in FIGS. 21(*a*) to 21(*c*) with the string 90. FIG. 29 shows the tip of the parallel movement tubular portion 200*a*. In FIG. 29, a direction perpendicular to the surface of the sheet is the axial direction of the parallel movement tubular portion 200*a*. The parallel movement tubular portion 200*a* has the tip-side opening 250*a*. As described above, the shape of the tip-side opening 250*a* is an elongated circle.

In FIG. 29, an arrow L1 indicates the inner dimension, in the direction parallel to the face 97, of the tip-side opening 250*a*. The inner dimension L1 is also the long diameter of the elongated circle. In FIG. 29, an arrow L2 indicates the inner dimension, in the direction perpendicular to the face 97, of the tip-side opening 250*a*. The inner dimension L2 is also the short diameter of the elongated circle. From the viewpoint that the string 90 easily becomes deformed in the direction parallel to the face 97 and is less likely to become deformed in the direction perpendicular to the face 97, the ratio (L1/L2) is preferably not less than 1.3 and particularly preferably not less than 1.5. The ratio (L1/L2) is preferably not greater than 4.0.

In FIG. 29, an arrow D indicates the diameter of the string 90. From the viewpoint that the string 90 easily becomes deformed in the direction parallel to the face 97, the ratio (L1/D) is preferably not less than 1.5 and particularly preferably not less than 1.8. The ratio (L1/D) is preferably not greater than 4.5.

Figure 30:
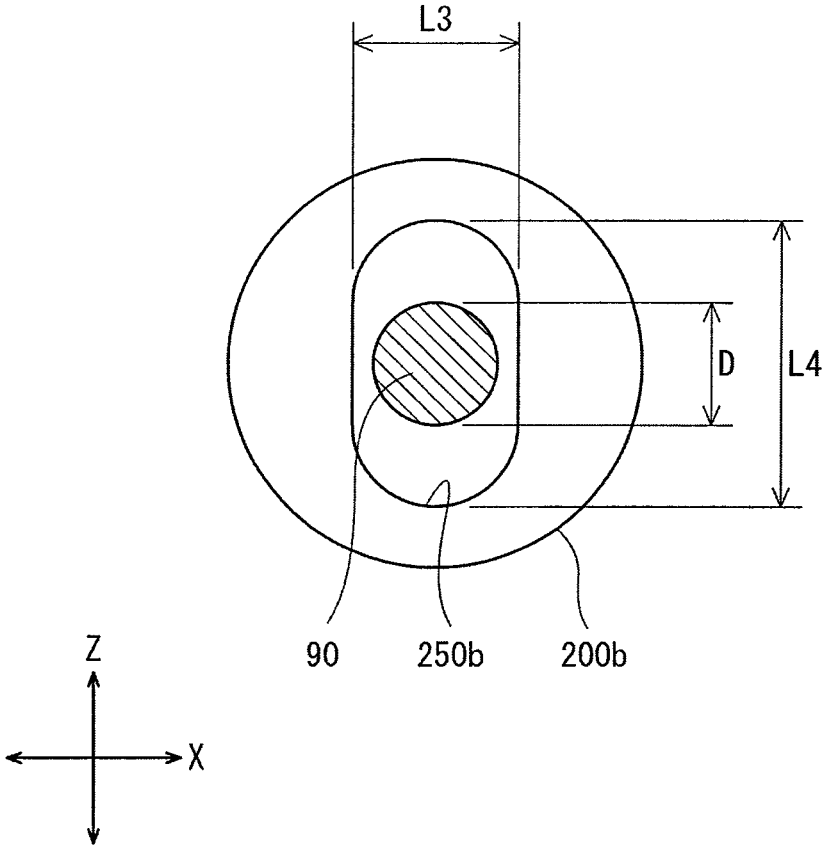
FIG. 30 is a bottom view of a vertical movement tubular portion in FIGS. 22(*a*) to 22(*c*) with the string.

FIG. 30 is a bottom view of the vertical movement tubular portion 200*b* in FIGS. 22(*a*) to 22(*c*) with the string 90. FIG. 30 shows the tip of the vertical movement tubular portion 200*b*. In FIG. 30, a direction perpendicular to the surface of the sheet is the axial direction of the vertical movement tubular portion 200*b*. The vertical movement tubular portion 200*b* has the tip-side opening 250*b*. As described above, the shape of the tip-side opening 250*b* is an elongated circle.

In FIG. 30, an arrow L3 indicates the inner dimension, in the direction parallel to the face 97, of the tip-side opening 250*b*. The inner dimension L3 is also the short diameter of the elongated circle. In FIG. 30, an arrow L4 indicates the inner dimension, in the direction perpendicular to the face 97, of the tip-side opening 250*b*. The inner dimension L4 is also the long diameter of the elongated circle. From the viewpoint that the string 90 easily becomes deformed in the direction perpendicular to the face 97, the ratio (L4/L3) is preferably not less than 1.3 and particularly preferably not less than 1.5. The ratio (L4/L3) is preferably not greater than 4.0.

In FIG. 30, an arrow D indicates the diameter of the string 90. From the viewpoint that the string 90 easily becomes deformed in the direction perpendicular to the face 97, the ratio (L4/D) is preferably not less than 1.5 and particularly preferably not less than 1.8. The ratio (L4/D) is preferably not greater than 4.5.

Second Embodiment

Figure 31:
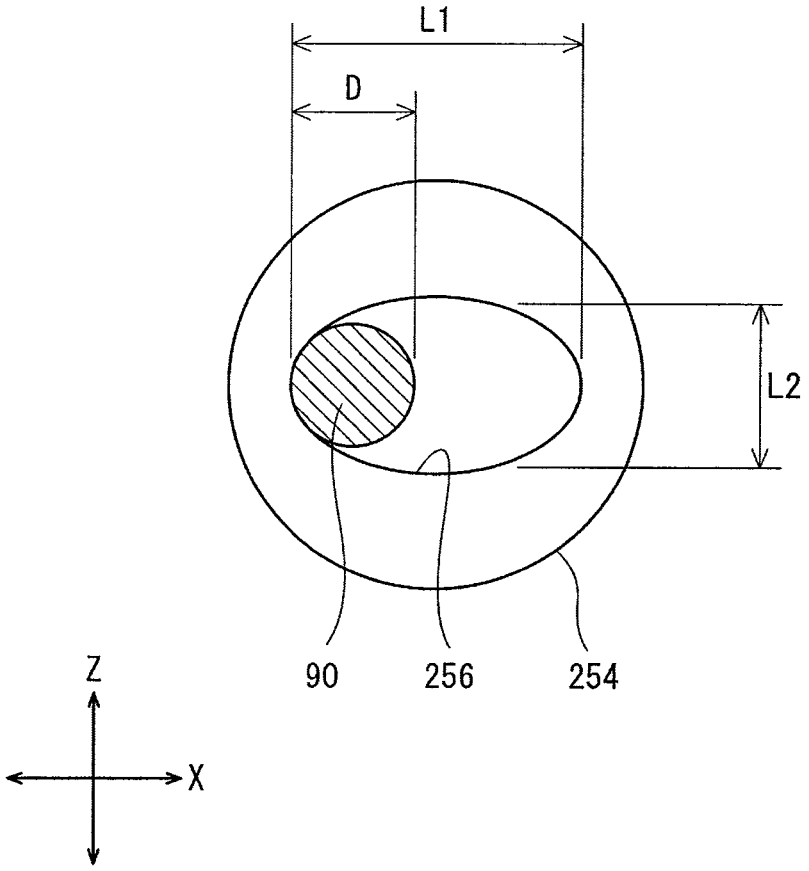
FIG. 31 is a bottom view of a parallel movement tubular portion of a tennis racket according to still another embodiment of the present invention with a string.

FIG. 31 is a bottom view of a parallel movement tubular opening 254 of a tennis racket according to another embodiment of the present invention with a string 90. The structure of the tennis racket other than the parallel movement tubular opening 254 is the same as that of the tennis racket 82 shown in FIGS. 17 to 30.

The parallel movement tubular opening 254 has a through hole. The through hole has a base-side opening, a side wall, and a tip-side opening 256. The cross-sectional shape of the through hole is uniform from the base-side opening to the tip-side opening 256. As shown in FIG. 31, the shape of the tip-side opening 256 is an ellipse. In FIG. 31, an arrow L1 indicates the inner dimension, in a direction parallel to a face, of the tip-side opening 256. The inner dimension L1 is also the major diameter of the ellipse. In FIG. 31, an arrow L2 indicates the inner dimension, in a direction perpendicular to the face, of the tip-side opening 256. The inner dimension L2 is also the minor diameter of the ellipse. From the viewpoint that the string 90 easily becomes deformed in the direction parallel to the face and is less likely to become deformed in the direction perpendicular to the face, the ratio (L1/L2) is preferably not less than 1.3 and particularly preferably not less than 1.5. The ratio (L1/L2) is preferably not greater than 4.0.

In FIG. 31, an arrow D indicates the diameter of the string 90. From the viewpoint that the string 90 easily becomes deformed in the direction parallel to the face, the ratio (L1/D) is preferably not less than 1.5 and particularly preferably not less than 1.8. The ratio (L1/D) is preferably not greater than 4.5.

Third Embodiment

Figure 32:
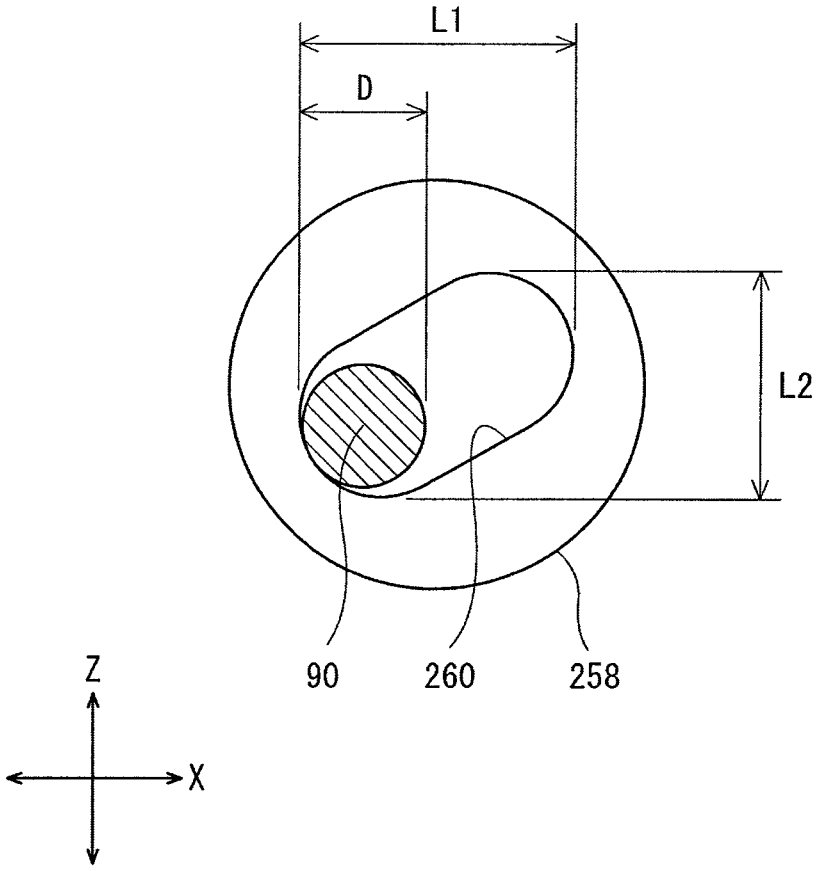
FIG. 32 is a bottom view of a parallel movement tubular portion of a tennis racket according to still another embodiment of the present invention with a string.

FIG. 32 is a bottom view of a parallel movement tubular portion 258 of a tennis racket according to still another embodiment of the present invention with a string 90. The structure of the tennis racket other than the parallel movement tubular portion 258 is the same as that of the tennis racket 82 shown in FIGS. 17 to 30.

The parallel movement tubular portion 258 has a through hole. The through hole has a base-side opening, a side wall, and a tip-side opening 260. The cross-sectional shape of the through hole is uniform from the base-side opening to the tip-side opening 260. As shown in FIG. 32, the shape of the tip-side opening 260 is an elongated circle. The long axis of the elongated circle is tilted in a direction parallel to a face. In FIG. 32, an arrow L1 indicates the inner dimension, in the direction parallel to the face, of the tip-side opening 260. In FIG. 32, an arrow L2 indicates the inner dimension, in a direction perpendicular to the face, of the tip-side opening 260. From the viewpoint that the string 90 easily becomes deformed in the direction parallel to the face and is less likely to become deformed in the direction perpendicular to the face, the ratio (L1/L2) is preferably not less than 1.3 and particularly preferably not less than 1.5. The ratio (L1/L2) is preferably not greater than 4.0.

In FIG. 32, an arrow D indicates the diameter of the string 90. From the viewpoint that the string 90 easily becomes deformed in the direction parallel to the face, the ratio (L1/D) is preferably not less than 1.5 and particularly preferably not less than 1.8. The ratio (L1/D) is preferably not greater than 4.5.

Fourth Embodiment

Figure 33B:
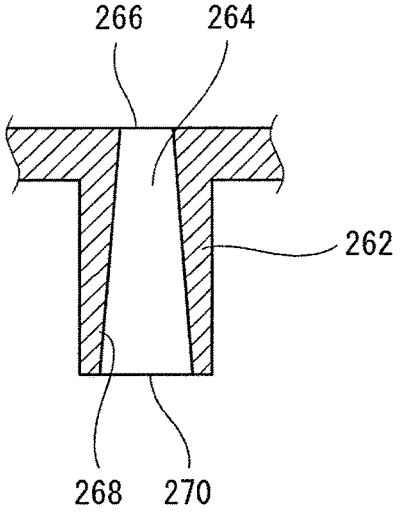
FIG. 33(*a*) is a front view of a parallel movement tubular portion of a tennis racket according to still another embodiment of the present invention.
Figure 33A:
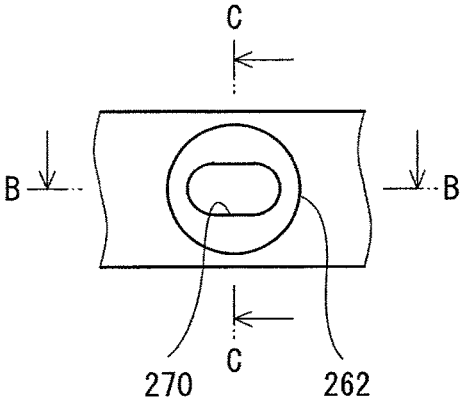
Figure 33C:
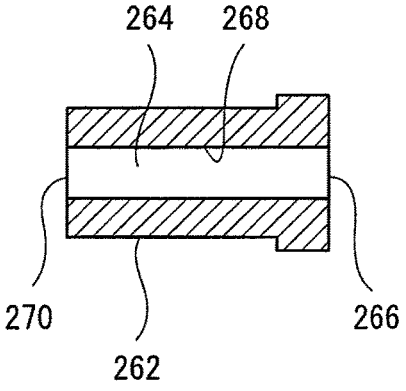

FIG. 33(*a*) is a front view of a parallel movement tubular portion 262 of a tennis racket according to still another embodiment of the present invention, FIG. 33(*b*) is a cross-sectional view taken along a line B-B in FIG. 33(*a*), and FIG. 33(*c*) is a cross-sectional view taken along a line C-C in FIG. 33(*a*). The structure of the tennis racket other than the parallel movement tubular portion 262 is the same as that of the tennis racket 82 shown in FIGS. 17 to 30.

The parallel movement tubular portion 262 has a through hole 264. The through hole 264 has a base-side opening 266, a side wall 268, and a tip-side opening 270. The shape of the base-side opening 266 is a circle. The shape of the tip-side opening 270 is an elongated circle. The inner dimension, in a direction parallel to a face, of the through hole 264 gradually increases from the base-side opening 266 toward the tip-side opening 270. In the tennis racket, a longitudinal string passed through the parallel movement tubular portion 262 can easily become deformed in the direction parallel to the face.

Still Another Embodiment

For a parallel movement tubular portion, through holes with various shapes that mainly permit movement of a string in a direction parallel to a face can be used. In each of the through holes, the ratio (L1/L2) of the inner dimension L1, in the direction parallel to the face, of a tip-side opening to the inner dimension L2, in a direction perpendicular to the face, of the tip-side opening is preferably not less than 1.3 and particularly preferably not less than 1.5. The ratio (L1/L2) is preferably not greater than 4.0.

For a vertical movement tubular portion, through holes with various shapes that mainly permit movement of the string in the direction perpendicular to the face can be used. In each of the through holes, the ratio (L4/L3) of the inner dimension L4, in the direction perpendicular to the face, of a tip-side opening to the inner dimension L3, in the direction parallel to the face, of the tip-side opening is preferably not less than 1.3 and particularly preferably not less than 1.5. The ratio (L4/L3) is preferably not greater than 4.0.

The racket according to the present invention can be used in various sports such as soft tennis, squash, and badminton. The above descriptions are merely illustrative examples, and various modifications can be made without departing from the principles of the present invention.

What is claimed is:

1. A racket comprising a frame, a grommet mounted on the frame and having a plurality of tubular portions, and a string forming a face, wherein each of the tubular portions has a through hole through which the string is passed, the through hole has a base-side opening, a side wall, and a tip-side opening, at least one of the tubular portions has a non-circular tip-side opening in which an inner dimension in a direction parallel to the face is larger than an inner dimension in a direction perpendicular to the face, and in the tubular portion having the non-circular tip-side opening, the string is in contact with the side wall from the base-side opening to the tip-side opening.

2. The racket according to claim 1, wherein a longitudinal string is passed through the tubular portion having the non-circular tip-side opening.

3. The racket according to claim 2, wherein the tubular portion having the non-circular tip-side opening is disposed near a top of the frame.

4. The racket according to claim 3, wherein, in the tubular portion having the non-circular tip-side opening, the string is in contact with a wall surface, at an inner side in a width direction, of the side wall.

5. The racket according to claim 1, wherein the tubular portion having the non-circular tip-side opening has a through hole having a uniform cross-sectional shape from the base-side opening to the tip-side opening.

6. The racket according to claim 1, wherein a contour of the non-circular tip-side opening is an ellipse or an elongated circle.

7. The racket according to claim 1, wherein a ratio (L1/L2) of an inner dimension L1, in the direction parallel to the face, of the non-circular tip-side opening to an inner dimension L2, in the direction perpendicular to the face, of the non-circular tip-side opening is not less than 1.3.

8. The racket according to claim 1, wherein a ratio (L1/D) of an inner dimension L1, in the direction parallel to the face, of the non-circular tip-side opening to a diameter D of the string is not less than 1.5.

9. A racket comprising a frame, a grommet mounted on the frame and having a plurality of tubular portions, and a string forming a face, wherein each of the tubular portions has a through hole through which the string is passed, and the tubular portions include parallel movement tubular portions that mainly permit movement of the string in a direction parallel to the face, and vertical movement tubular portions that mainly permit movement of the string in a direction perpendicular to the face.

10. The racket according to claim 9, wherein each of the parallel movement tubular portions is adjacent to at least one vertical movement tubular portion.

11. The racket according to claim 9, wherein each of the vertical movement tubular portions is adjacent to at least one parallel movement tubular portion.

12. The racket according to claim 9, wherein each of the parallel movement tubular portions has a through hole in which an inner dimension in the direction parallel to the face is larger than an inner dimension in the direction perpendicular to the face.

13. The racket according to claim 12, wherein a cross-sectional shape of the through hole of each of the parallel movement tubular portions is an ellipse or an elongated circle.

14. The racket according to claim 12, wherein a ratio (L1/L2) of an inner dimension L1, in the direction parallel to the face, of the through hole of each of the parallel movement tubular portions to an inner dimension L2, in the direction perpendicular to the face, of the through hole of each of the parallel movement tubular portions is not less than 1.3.

15. The racket according to claim 12, wherein a ratio (L1/D) of an inner dimension L1, in the direction parallel to the face, of the through hole of each of the parallel movement tubular portions to a diameter D of the string is not less than 1.5.

16. The racket according to claim 12, wherein the through hole of each of the parallel movement tubular portions has a base-side opening, a side wall, and a tip-side opening, and in each of the parallel movement tubular portions, the string is in contact with the side wall from the base-side opening to the tip-side opening.

17. The racket according to claim 16, wherein, in each of the parallel movement tubular portions, the string is in contact with a wall surface, at an inner side in a width direction, of the side wall.

18. The racket according to claim 16, wherein each of the parallel movement tubular portions has a through hole having a uniform cross-sectional shape from the base-side opening to the tip-side opening.

19. The racket according to claim 9, wherein a longitudinal string is passed through each of the parallel movement tubular portions, and another longitudinal string is passed through each of the vertical movement tubular portions.

20. The racket according to claim 9, wherein the parallel movement tubular portions and the vertical movement tubular portions are disposed near a top of the frame.

* * * * *